United States Patent [19]

Abe et al.

[11] Patent Number: 5,034,308

[45] **Date of Patent: * Jul. 23, 1991**

[54] METHOD FOR PROCESSING SILVER HALIDE PHOTOSENSITIVE MATERIAL INCLUDING THE REPLENISHING OF WASHING WATER CONTAINING A CHELATING AGENT AND A CONTROLLED AMOUNT OF CALCIUM AND MAGNESIUM COMPOUNDS

[75] Inventors: Akira Abe; Yoshihiro Fujita; Toshio Koshimizu; Kazuhiro Aikawa, all of Minami-Ashigara, Japan

[73] Assignee: Fuji Photo Film Co., Ltd., Minami-Ashigara, Japan

[ * ] Notice: The portion of the term of this patent subsequent to Jun. 13, 2006 has been disclaimed.

[21] Appl. No.: 86,790

[22] Filed: Aug. 19, 1987

[30] Foreign Application Priority Data

Aug. 22, 1986 [JP] Japan ..... 61-196918

[51] Int. Cl.[5] ..... G03C 5/395

[52] U.S. Cl. ..... 430/372; 430/393; 430/398; 430/401; 430/421; 430/430; 430/463; 430/467; 430/490; 430/491

[58] Field of Search ..... 430/401, 491, 421, 463, 430/393, 430, 467, 490, 372, 398

[56] References Cited

U.S. PATENT DOCUMENTS

| | | | |
|---|---|---|---|
| 2,193,015 | 3/1940 | Weissberger | 430/470 |
| 2,592,364 | 4/1952 | Weissberger et al. | 430/470 |
| 3,189,454 | 6/1965 | Luckey et al. | 430/401 |
| 3,462,269 | 8/1969 | Tassone | 430/467 |
| 3,647,461 | 3/1972 | Surash et al. | 430/467 |
| 3,647,462 | 3/1972 | Surash et al. | 430/467 |
| 4,264,716 | 4/1981 | Vincent et al. | 430/467 |
| 4,336,324 | 6/1982 | Kobushi et al. | 430/421 |
| 4,839,273 | 6/1989 | Yamada et al. | 430/421 |
| 4,855,218 | 8/1989 | Fujita et al. | 430/393 |

FOREIGN PATENT DOCUMENTS 60-239750 11/1985 Japan .

OTHER PUBLICATIONS

C. R. Dupree, "Practical Operating of Ion Exchange Equipment for Photographic Wash Water Purification" Photographic Engineering.

H. P. Coregor, "Application of Ion Exchange Resins in Photographic Processing" Photographic Engineering, vol. 2, No. 3, 1951, pp. 102-109.

J. H. Priesthoff "Improved Technique for Ion-Exchange Recovery of Eastman Color Developers" Journal of the SMPIE vol. 66 Feb. 1957, pp. 64-65.

Goldwasser, SMPTE Journal, "Water Flow Rates in Immersion Washing of Motion Picture Film" May 1955.

The Quality of Water for Photographic Processing, Lloyd E. West, Photographic Science and Engineering, vol. 3, No. 6, Nov.-Dec. 1959, p. 283.

*Primary Examiner*—Charles L. Bowers, Jr.
*Assistant Examiner*—Lee C. Wright
*Attorney, Agent, or Firm*—Burns, Doane, Swecker & Mathis

[57] ABSTRACT

A method for processing silver halide photosensitive materials comprising developing an exposed silver halide photosensitive material, fixing the developed photosensitive material and then washing it with a washing water, the washing water used in the water washing process being replenished in an amount of 2 to 50 times the volume of liquid carried over by the photosensitive material from a bath preceding the water washing bath per unit area thereof, the amount of calcium and magnesium compounds present in the water washing bath being reduced to not more than 5 mg/l, respectively, on the basis of elemental calcium and magnesium and the washing water containing at least one chelating agent having a stability constant of a chelate, which is formed between the chelating agent and calcium or magnesium, of at least 6 is herein disclosed. The method makes it possible to suppress the increase in turbidity due to the proliferation of bacteria and molds in washing bath even when the processing is continuously conducted while substantially saving the amount of washing water and further provides an excellent processed photosensitive materials.

16 Claims, 1 Drawing Sheet

METHOD FOR PROCESSING SILVER HALIDE PHOTOSENSITIVE MATERIAL INCLUDING THE REPLENISHING OF WASHING WATER CONTAINING A CHELATING AGENT AND A CONTROLLED AMOUNT OF CALCIUM AND MAGNESIUM COMPOUNDS

BACKGROUND OF THE INVENTION (1) Field of the Invention

The present invention relates to a method for processing silver halide color photosensitive materials, in particular to a processing method which makes it possible to suppress the increase in turbidity due to the proliferation of bacteria and propagation of mold in a washing bath even when the processing is continuously conducted while substantially saving the amount of washing water, and which provides an excellent processed photosensitive material.

(2) Description of the Prior Art

Recently, it has been proposed to reduce the amount of washing water used in water washing and other processes for processing silver halide photosensitive materials, in view of environmental protection, exhaustion of water resources and economical merits. For example, one of such techniques for reducing the amount of washing water is proposed by S. R. Goldwasser in his article entitled *Water Flow Rates in Immersion-Washing of Motion Picture Film,* Journal of the Society of Motion Picture and Television Engineers, 1955, Vol. 64, pp. 248–253 in which saving of the amount of washing water is achieved by employing a multistage washing system including the use of a plurality of washing tanks and countercurrently passing water therethrough. Likewise, U.S. Pat. No. 4,336,324 discloses another method comprising directly transferring bleached and fixed photosensitive materials to stabilization process without passing them through washing process to save the amount of washing water. These methods have been adopted in different kinds of automatic processors as an effective means for water saving.

However, if the water saving is effected without implementing any other countermeasures, the retention time of water in the washing bath is substantially increased, which results in the proliferation of bacteria and in turn causes the formation of suspended matters and thus an increase in the turbidity of washing water. Moreover, various molds are liable to proliferate.

Such proliferation of bacteria and molds lowers the quality of the processed color photosensitive materials because of the deposition of bacteria and molds caused during the water washing process. In addition, the proliferation of bacteria and molds causes problems such that circulating pumps and filters which are disposed for such baths as the washing and stabilizing baths become clogged within a very short time and that the water becomes foul and produces a bad smell.

In order to solve such problems, many attempts have been made, for example, Japanese Patent Un-examined Publication No. 57-8542 proposes a method which comprises adding an antibacterial or antifungus agent such as isothiazolone type agents, or benzoisothiazolone type agents to the washing and/or stabilizing bath.

The addition of such an antibacterial or antifungus agent is effective for solving the foregoing problems. However, the presence thereof in these baths may impair the safety of the working environment since they are heated in the drying process and evaporate into the ambient atmosphere. Therefore, an extra investment is required for installing an exhaust system or the like. Moreover, the use of these antibacterial and/or antifungus agents causes side effects. For example they make the processed photosensitive materials quite sticky and these materials are liable to adhere to one another or to other materials. Thus, there has not yet been proposed a processing method for silver halide photosensitive materials which can completely eliminate the foregoing problems.

SUMMARY OF THE INVENTION

Under such circumstances, the inventors of the present invention conducted studies to eliminate aforementioned drawbacks associated with the conventional methods for processing silver halide photosensitive materials and to develop a new processing method which permits the complete elimination of such disadvantages and a substantial saving in the amount of washing water.

Accordingly, it is a principal object of the present invention to provide a method for processing silver halide photosensitive materials which makes it possible to positively suppress the proliferation of bacteria and molds in washing baths while substantially saving the amount of washing water.

Another object of this invention is to provide a method for processing silver halide photosensitive materials which makes it possible to substantially save the amount of washing water even if no antibacterial or antifungus agents are employed.

A further object of the present invention is to provide an apparatus for processing silver halide photosensitive materials which permits the effective practice of the foregoing processing method capable of saving the amount of washing water.

These and other objects of the present invention will be more apparent from the description given below.

The inventors of this invention found that the foregoing drawbacks of the conventional method for processing silver halide photosensitive materials can effectively be eliminated by restricting the amount of washing water to be replenished to washing baths to a specific range and simultaneously limiting the amount of calcium ions and magnesium ions present in the washing bath to not more than a specific value. The present invention has been completed on the basis of these findings.

In accordance with the present invention, there is provided a method for processing silver halide photosensitive materials which comprises color developing an exposed silver halide photosensitive material, treating the color developed photosensitive material in a fixing process and then washing the photosensitive material with washing water, the method comprising that the washing water is replenished in an amount of 1 to 50 times the volume of liquid carried over by the photosensitive material from a bath preceding the water washing bath per unit area thereof, and that the amount of calcium and magnesium compounds present in the replenishing washing water are reduced to not more than 5 mg/l respectively on the basis of elemental calcium or magnesium, and that the washing water contains at least one chelating agent having the stability constant of chelate formed with calcium or magnesium of at least 6.

BRIEF EXPLANATION OF THE DRAWING

The present invention will hereunder be explained in more detail with reference to the accompanying drawing, in which.

DETAILED EXPLANATION OF THE PREFERRED EMBODIMENTS

Figure 1:
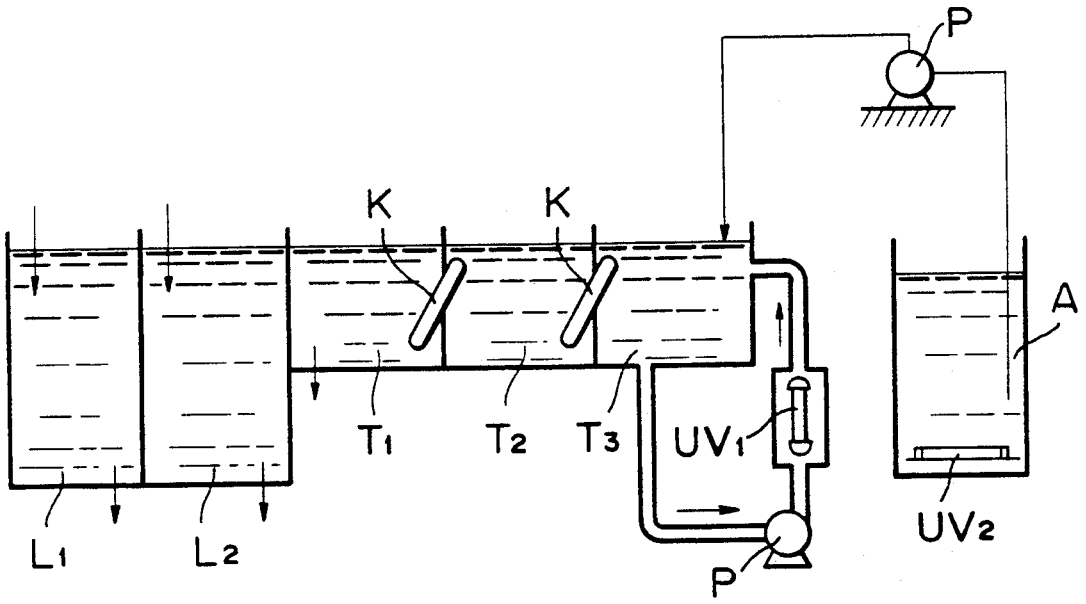
FIG. 1 is a schematic diagram illustrating an apparatus for carrying out the processing method according to the present invention.

In the present invention, the term "water washing" means a process for washing out the processing solution adhering to or absorbed by the processed photosensitive materials as well as components of the photosensitive materials which have become useless during the processing and thus is a process for maintaining the performance of the subsequent processing baths and/or assuring a variety of properties of the processed photosensitive materials such as shelf stability of images. Therefore, the washing process herein referred to includes any processes so far as the aforementioned purposes or effects are surely achieved, regardless of the compositions of the liquids used therein.

Thus, the method according to the present invention can be applied to any washing processes in a series of development processes for photosensitive materials, irrespective of whither the washing process is an intermediate washing process or the like.

In the method of this invention, it is desirable that the water washing process comprise at least two washing baths, preferably 2 to 6 baths, more preferably 2 to 4 baths and it is also desirable to counter-currently introduce the replenishing washing water into the baths in an amount of 2 to 50 times, preferably 3 to 30 times, the volume of the processing liquid carried over by the processed photosensitive material from the bath preceding the washing bath per unit area thereof. Moreover, in the method of this invention, the amount of calcium and magnesium compounds included in at the least washing water in the final washing bath in the washing process is reduced to 5 mg/l or less expressed as elemental calcium and magnesium, respectively. It is particularly preferred to control the concentration of calcium and magnesium in the baths, except for the first washing bath, to not more than 5 mg/l, more preferably not more than 3 mg/l.

The control of the amount of calcium and magnesium compounds in each washing bath may be accomplished according to any known methods. For example, the amount thereof in the washing water (inclusive of the replenishing water) can be reduced to not more than the above mentioned value by using an ion exchange technique, a technique employing zeolite and an reverse osmosis technique. These techniques may be used alone or in combination.

In the ion exchange technique, various cation exchange resins may be used herein. Preferred examples thereof are those of Na-type capable of exchanging Ca and Mg with Na. In addition, H-type cationic ion exchange resins may also be used. However, in this case, it is preferable to use the resin together with an OH-type anionic ion exchange resin since the pH of the processed water becomes acidic when an H-type one is used alone.

In this respect, preferred ion exchange resins are strong acidic cation exchange resins which are mainly composed of styrene-divinylbenzene copolymer and have sulfonic groups as the ion exchange group. Examples of such an ion exchange resin include Diaion SK-1B or Diaion PK-216 (manufactured and sold by Mitsubishi Chemical Industries Ltd.). The basic copolymer of these ion exchange resins preferably comprises 4 to 16% by weight of divinylbenzene on the basis of the total charge weight of monomers at the time of preparation. Moreover, preferred examples of anion exchange resins which may be used in combination with H-type cation exchange resins are strong basic anion exchange resins which mainly comprise styrene-divinylbenzene copolymer and have tertiary or quaternary ammonium groups as the ion exchange group. Concrete examples thereof include Diaion SA-10A or Diaion PA-418 (also manufactured and sold by Mitsubishi Chemical Industries Ltd.).

Any known method may be employed when calcium and magnesium ions included in washing water are removed with these ion exchange resins. However, it is preferred to pass washing water to be treated through a column packed with such an ion exchange resin. The flow rate of the water in the column is in general 1 to 100 times the volume of the resin packed therein per hour, preferably 5 to 50 times thereof.

Any known apparatuses for reverse osmosis may be used in the method of this invention. Such apparatus for reverse osmosis is in general provided with a membrane and examples thereof include membrane of cellulose acetate, membrane of ethylcellulose-polyacrylic acid copolymer, membrane of polyacrylonitrile, membrane of polyvinylene carbonate and membrane of polyether sulfone.

The pressure for passing liquid through the membrane usually falls within the range of from 5 to 60 $kg/m^2$. However, it is sufficient to use a pressure of not more than 30 $kg/m^2$ to achieve the purposes of the present invention and a so-called low-pressure reverse osmotic apparatus operated at a pressure of 10 $kg/m^2$ or less can also be used in the present invention effectively.

The structure of the membrane for reverse osmosis may be spiral, tubular, hollow fiber, pleated or rod type.

Zeolites which may be used in the present invention are water-insoluble aluminum silicates represented by the following general formula:

$$(Na(AlO_2))_x \cdot (SiO_2)_y \cdot Z(H_2O)$$

In the present invention, A-type zeolites having the above general formula in which x is equal to y and X-type zeolites in which x is different from y may be used. In particular, X-type zeolites are preferred because of their high ion exchange capacity with respect to both calcium and magnesium. An example of such a zeolite includes molecular sieve LINDE ZB-300 (manufactured and sold by Union Carbide Corp.). Zeolites having different particle sizes are known. However, those having a particle size of more than 30 mesh are preferable when packed in a column to bring it into contact with washing water.

In the method of the present invention, the amount of calcium and magnesium ions present in the replenishing washing water are reduced to not more than a specific value as already mentioned above. According to the method of the present invention, at least one chelating agent is further added to the washing water and such a chelating agent is selected from the group consisting of those forming a chelate complex with calcium and magnesium ions in the washing water, the stability constant ($K_{MA}$) of which is not less than 6, preferably not less than 8, most preferably not less than 10.

In this connection, the stability constant, $K_{MA}$, herein used is defined as follows:

$$K_{MA} = \frac{(MA)}{(M)(A)}$$

wherein (MA) means the molar concentration of a metal chelate, (M) that of the metal ions and (A) that of the anion of the chelating agent.

As to such a chelating agent providing the foregoing stability constant, reference is made to K. UENO, Metal Chelates III, 19, published by NANKODO; Comprehensive Catalogue for Dotite Reagents, 19, 13th ed., issued by DOGIN Chemical Laboratories; and L. G. Sillen et al., Stability Constant of Metal Complex, 1964, issued by Chemical Society.

Concrete examples of these chelating agents include those listed below:

| | $K_{MA}$ | |
|---|---|---|
| | Ca | Mg |
| Ethylenediaminetetraacetic acid (EDTA) | 10.85 | 8.69 |
| Cyclohexanediaminetetraacetic acid (CDTA) | 12.08 | 10.32 |
| Diethylenetriaminepentaacetic acid (DTPA) | 10.74 | 9.3 |
| Hydroxyethylethylenediaminetriacetic acid (EDTA-OH) | 8.14 | 7.0 |
| Triethylenetetraminehexaacetic acid (TTHA) | 10.06 | 8.47 |
| Diaminopropanol tetraacetic acid (DPTA-OH) | 6.60 | 8.96 |
| 1,2-Diaminopropanetetraacetic acid (Methyl-EDTA) | 11.47 | 10.29 |
| Ethylenediaminetetramethylene phosphonic acid (EDTPO) | 6.93 | 12.70 |
| Ethylenediamine-N,N'-diacetic acid-di-(2-propionic acid) | 10.74 | 9.41 |
| 1,3-Diaminopropanetetraacetic acid | 7.21 | 6.02 |

It is preferred in the present invention to use chelating agents such as those listed above and soluble salts thereof such as alkali metal salts and ammonium salts alone or in combination. The amount of the chelating agent is not critical in the present invention. However, it is preferred to use these chelating agents in an amount of from $3\times10^{-4}$ to $3\times10^{-2}$ moles per liter, preferably from $1\times10^{-3}$ to $1\times10^{-2}$ moles/l.

Furthermore, in the method of the present invention, it is preferred to irradiate, with ultraviolet rays, washing water included in at least one bath selected from water washing baths and auxiliary tanks, which permits the suppression of the proliferation of molds.

The source of ultraviolet light as used herein may be an ultraviolet lamp such as a low pressure mercury vapor discharge tube which emits light of 253.7 nm is wavelength. In the present invention, preferred are those having bactericidal ray outputs ranging from 0.5 W to 7.5 W. The ultraviolet lamp may be disposed outside or inside the water to be irradiated.

As already explained above, an antibacterial or antifungus agent need not necessarily be used in the method of the present invention. However, they may be used depending on purposes.

The antibacterial or antifungus agents which can be used in the method of the present invention include, for instance, isothiazolone type antibacterial agents such as 5-chloro-2-methyl-4-isothiazolin-3-one, 2-methyl-4-isothiazolin-3-one; benzoisothiazolone type antibacterial agents such as 1,2-benzoisothiazolin-3-one; triazole derivatives such as benzotriazole; sulfamide type antibacterial agents such as sulfanilamide; organoarsenide type mold control agents such as 10,10'-oxybisphenoxyarsine and those disclosed in *Bokin Bobaizai No Kagaku* (Chemistry of antibacterial and mold control agents), Hiroshi HORIGUCHI, Society of Hygienic Engineerings, entitled *Techniques for Sterilization, Pasteurization and Mold Control,* 19, published by Each of the water washing baths should be adjusted to pH 5 to 9 in the method of this invention and the pH of the washing water supplied to these baths is preferably in the range of 4 to 9, more preferably of 6 to 8.

The processing time of the water washing process in the method according to the present invention is in general in the range of 20 seconds to 3 minutes, preferably 30 seconds to 2 minutes, and the processing is carried out at a temperature of 20° to 40° C. and preferably 30° to 38° C.

The processes for silver halide color photosensitive materials to which the method of the present invention can be applied are, for example, as follows:

A. Color Development—Bleaching and Fixing—Water Washing—Drying;

B. Color Development—Water Washing—Bleaching and Fixing—Water Washing—Drying;

C. Color Development—Bleaching—Fixing—Water Washing—Drying;

D. Color Development—Bleaching—Bleaching and Fixing—Water Washing—Drying;

E. Color Development—Bleaching—Bleaching and Fixing—Water Washing—Drying;

F. Color Development—Fixing—Bleaching and Fixing—Water Washing—Drying.

In addition to these processes A to F, the method of the present invention may also be applied to those in which a stabilization process is additionally inserted between the water washing and drying processes of these processes A to F.

Each of the processing baths or processing solutions will now be explained below.

Color Developing Bath or Solution

The color developing solution used for the development of the photosensitive materials of the present invention is preferably an aqueous alkaline solution containing an aromatic primary amine type color developing agent as a main component. Although, aminophenolic compounds are useful as the color developing agent, p-phenylenediamine type compounds are preferred.

As examples of the later, there can be included 3-methyl-4-amino-N,N'-diethylaniline, 3-methyl-4-amino-N-ethyl-N-beta-hydroxyethylaniline, 3-methyl-4-amino-N-ethyl-N-betamethanesulfonamidethylaniline, 4-amino-3-methyl-N-ethyl-N-beta-methoxyethylaniline or sulfate, hydrochloride, phosphate, p-toluenesulfonate, tetraphenylborate and p-(t-octyl)-benzenesulfonate thereof. These diamines are generally more stable in a salt state than in a free state and, therefore, the salts are preferably used. Examples of the aminophenol type derivatives are o-aminophenol, p-aminophenol. 4-amino-2-methylphenol, 2-amino-3-methylphenol and 2-oxy-3-amino-1,4-dimethylbenzene.

In addition, those described in L. F. A. Mason, *Photographic Processing Chemistry,* Focal Press (1966), pp. 226 to 229; U.S. Pat. Nos. 2,193,015 and 2,592,364 and Japanese Patent Un-examined Publication No. 48-64933 may be used. These color developing agents may be used in combination according to need.

A color developing solution generally contains a pH buffering agent such as carbonate, borates and phosphates of alkali metals; a development restrainer or antifoggant such as bromide, iodide, benzimidazoles, benzothiazoles and mercapto compounds; a preservative such as hydroxylamine, diethyl hydroxylamine, triethanolamine, compounds described in DEOS No. 2,622,950; sulfite and hydrogen sulfite; an organic solvent such as ethylene glycol; a development accelerator such as benzylalcohol, polyethylene glycol, quaternary ammonium salts, amines, thiocyanate and 3,6-thiaoctane-1,8-diol; a dye-forming coupler; a competing coupler; a nucleus forming agent such as sodium borohydride; an auxiliary developing agent such as 1-phenyl-3-pyrazolidone; a thickener; a chelating agent such as ethylenediaminetetraacetic acid, nitrirotriacetic acid, cyclohexanediaminetetraacetic acid, iminodiacetic acid, N-hydroxymethylethylenediaminetetraacetic acid, diethylenetriaminepentaacetic acid, triethylenetetraminehexaacetic acid, aminopolycarboxylic acids as described in Japanese Patent Un-examined Publication No. 58-195844, 1-hydroxyethylidene-1,1'-diphosphonic acid, organic phosphonic acids as described in Research Disclosure 18170 (May, 1979), aminophosphonic acids such as aminotris (methylenephosphonic acid) and ethylenediamine-N,N,N',N'-tetramethylenephosphonic acid, and phosphonocarboxylic acids as described in Japanese Patent Un-examined Publication Nos. 52-102726, 53-42730, 54-121127, 55-4024, 55-4025, 55-126241, 55-65955 and 55-65956, and Research Disclosure 18170 (May, 1979).

The color developing agent is generally used in an amount of about 0.1 to about 30 g, preferably about 1 to about 15 g per liter of a color developing solution. The pH of the color developing solution is generally 7 or higher and most generally about 9 to about 13. Furthermore, it is possible to use an auxiliary solution in which the concentrations of halides, a color developing agent and the like are adjusted, so as to decrease the amount of a replenisher for the color developing bath.

In the method of the present invention, it is preferred that the color developing solution be substantially free from benzyl alcohol listed above as an example of a development accelerator. In this respect, the term "substantially free from" means that benzyl alcohol is present in the color developing solution in an amount of 2 ml or less per liter of the latter, preferably 0.5 ml or less and most preferably is totally absent. If benzyl alcohol is not included in the color developing solution, a better effect is attained.

The processing temperature in the color developing solution preferably ranges from 20° to 50° C. and more preferably from 30° to 40° C. The processing time is preferably in the range of from 20 seconds to 10 minutes and more preferably from 30 seconds to 5 minutes.

Bleaching, Bleaching-Fixing and Fixing Solution

The photographic emulsion layers after the color development are usually subjected to a bleaching process. The bleaching may be carried out at the same time with a fixing treatment (called bleaching-fixing), or they may be carried out separately. In the bleaching-fixing process, a counterflow supplement method may be used, wherein two or more baths are present and the bleaching-fixing solution is fed to the later bath and the overflow liquid of the later bath is introduced into the former bath.

An example of the bleaching agent used in the bleaching solution or the bleaching-fixing solution in the present invention is a ferric ion complex which is a complex of ferric ion with a chelating agent such as aminopolycarboxylic acid, aminopolyphosphonic acid or salts thereof. The aminopolycarboxylic acid salts or aminopolyphosphonic acid salts are an alkali metal salt, ammonium salt or water-soluble amine salt of aminopolycarboxylic acid or aminopolyphosphonic acid salt. The alkali metal is, for instance, sodium, potassium or lithium and examples of the water-soluble amires are, for instance, alkyl amines such as methylamine, diethylamine, triethylamine and butylamine; alicyclic amines such as cyclohexylamine; arylamines such as aniline and m-toluidine; and heterocyclic amines such as pyridine, morpholine and piperidine.

Typical examples of the chelating agents such as aminopolycarboxylic acid, aminopolyphosphonic acid and salts thereof are as follows. However, it should be appreciated that the invention is not limited to the following specific examples:

Ethylenediaminetetraacetic acid;
Disodium ethylenediaminetetraacetate;
Diammonium ethylenediaminetetraacetate;
Tetra (trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(beta-oxyethyl)-N,N',N'-triacetic acid;
Trisodium ethylenediamine-N-(beta-oxyethyl)-N,N',N'-triacetate;
Triammonium ethylenediamine-N-(beta-oxyethyl)-N,N',N'-triacetate;
1,2-Diaminopropanetetraacetic acid;
Disodium 1,2-diaminopropanetetraacetate;
1,3-Diaminopropanetetraacetic acid;
Diammonium 1,3-diaminopropanetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-Diaminepropanol-N,N,N'-N'-tetramethylenephosptonic acid;
Ethylenediamine-N,N,N',N'-tetramethylenephosphonic acid;
1,3-Propylenediamine-N,N,N',N'-tetramethylenephosphonic acid.

The ferric ion complex salt may be used in the form of one or more complex salts previously prepared or may be formed in a solution using a ferric salt, such as ferric sulfate, ferric chloride, ferric nitrate, ferric ammonium sulfate or ferric phosphate, and a chelating agent such as aminopolycarboxylic acid, aminopolyphosphonic acid or phosphonocarboxylic acid. When the complex salt is formed in a solution, one or more ferric salts may be used, and one or more chelating agents may also be used. In the case of either the previously prepared complex salt or the in situ formed one, the chelating agent may be used in an excess amount greater than that required to form the desired ferric ion salt. Among iron complexes, preferred is a complex of ferric ion with aminopolycarboxylic acid and the amount thereof used is in the range of 0.1 to 1 mole/l, preferably 0.2 to 0.4 moles/l in the case of bleaching solution for photographic color photosensitive materials such as color negative films. On the other hand, the compound is used in an amount of 0.05 to 0.5 moles/l, preferably 0.1 to 0.3 moles/l in the bleaching-fixing solution therefor. Moreover, it is used in an amount of 0.03 to 0.3 moles/l, preferably 0.05 to 0.2 moles/l in the case of the bleaching and bleaching-fixing solution for color photosensitive materials for print such as color paper.

To the bleaching solution and the bleaching-fixing solution, there may be added a bleaching accelerator according to need. Examples of useful bleaching accelerators are compounds having a mercapto group or a disulfide group such as those disclosed in U.S. Pat. No. 3,893,858; German Patent Nos. 1,290,812 and 2,059,988; Japanese Patent Un-examined Publication Nos. 53-32736, 53-57831, 53-37418, 53-65732, 53-72623, 53-95630, 53-95631, 53-104232, 53-124424, 53-141623 and 53-28426; and Research Disclosure No. 17129 (July, 1978); thiazoline derivatives such as those disclosed in Japanese Patent Un-examined Publication No. 50-140129; thiourea derivatives such as those disclosed in Japanese Patent Publication No. 45-8506; Japanese Patent Un-examined Publication Nos. 52-20832 and 53-32735; and U.S. Pat. No. 3,706,561; iodides such as those disclosed in German Patent No. 1,127,715 and Japanese Patent Un-examined Publication No. 58-16235; polyethylene oxides such as those disclosed in German Patent Nos. 966,410 and 2,748,430; polyamine compounds such as those disclosed in Japanese Patent Publication No. 45-8836; as well as compounds disclosed in Japanese Patent Unexamined Publication Nos. 49-42434, 49-59644, 53-94927, 54-35727, 55-26506 and 58-163940; and iodine and bromine ions. From the viewpoint of a high acceleration effect, preferred are compounds having a mercapto or a disulfide group among others and in particular, those disclosed in U.S. Pat. No. 3,893,858, German Patent No. 1,290,812 and Japanese Patent Unexamined Publication No. 53-96530 are preferred.

In the bleaching or bleaching-fixing solution as used in the present invention, bromides such as potassium bromide, sodium bromide and ammonium bromide; chlorides such as potassium chloride, sodium chloride and ammonium chloride; or iodides such as ammonium iodide may be contained as a rehalogenating agent. If necessary, one or more inorganic or organic acids and alkali or ammonium salts thereof having a pH buffering ability, such as, boric acid, borax, sodium metaborate, acetic acid, sodium acetate, sodium carbonate, potassium carbonate, phosphorous acid, phosphoric acid, sodium phosphate, citric acid, sodium citrate and tartaric acid, anti-corrosive such as ammonium nitrate and guanidine may be added.

The fixing agent used in the fixing or bleaching-fixing solution may be any conventional one, for instance, thiosulfates such as sodium thiosulfate and ammonium thiosulfate; thiocyanates such as sodium thiocyanate and ammonium thiocyanate; thioethers or thioureas such as ethylenebisthioglycollic acid, 3,6-dithia-1,8-octanediol, which are water-soluble, silver halide-solubilizing agents. These agents may be used alone or in combination. Further, the special bleaching-fixing solution consisting of a combination of a fixing agent and a large amount of halide such as potassium iodide described in Japanese Patent Unexamined Publication No. 51-155354 may be used in the bleaching-fixing process. In the present invention, preferred are thiosulfates, in particular, ammonium thiosulfate.

The concentration of the fixing agent in the fixing or bleaching-fixing treatment is preferably 0.3 to 2 moles/l. In particular, in the case of processing photographic color photosensitive materials, the amount thereof is in the range of 0.8 to 1.5 moles/l and in the case of color photosensitive materials for print, it ranges from 0.5 to 1 mole/l.

Generally, the pH value of the fixing or bleaching-fixing solution is preferably 3 to 10, more preferably 5 to 9. This is because, if the pH value is less than the lower limit, the desilvering effect is enhanced, however, the solutions are impaired and the cyan dye tends to be converted to leuco dye, while if the pH is more than the upper limit, the rate of desilvering is extremely lowered and there is a tendency for stains to be caused easily.

In order to adjust the pH, there may be added to the solutions, for instance, hydrochloric acid, sulfuric acid, nitric acid, acetic acid, bicarbonates, ammonia, caustic soda, caustic potash, sodium carbonate and potassium carbonate according to need. Further, various fluorescent brighteners, defoaming agents, surfactants, polyvinylpyrrolidone or organic solvents such as methanol may also be added to the bleaching-fixing solution.

The bleaching solution and bleaching-fixing solution as used herein contain a sulfite ion releasing compound, as the preservative, such as sulfite, for instance, sodium sulfite, potassium sulfite and ammonium sulfite; bisulfites, for instance, ammonium bisulfite, sodium bisulfite and potassium bisulfite; and metabisulfites, for instance, potassium metabisulfite, sodium metabisulfite and ammonium metabisulfite. These compounds are preferably present in an amount of about 0.02 to 0.5 moles/l explessed as sulfite ions and more preferably 0.04 to 0.40 moles/l.

Furthermore, other preservatives such as ascorbic acid, carbonyl bisulfite adduct or carbonyl compounds may be used although the bisulfites are generally used as the preservative.

In addition to the foregoing compounds, it is also possible to add buffering agents, fluorescent brighteners, chelating agents and mold controlling agents according to need.

The photosensitive materials to which the foregoing processing is applied are, for instance, color paper or color negative films.

First of all, in the emulsion layer of the color paper, silver chlorobromide having a silver bromide content of 10 mole % or more is preferably used. Moreover, the silver bromide content is preferably 20 mole % or more in order to obtain an emulsion having a sufficient sensitivity without causing undesired increase in fogging and in particular when rapidity is required in color development processing, the content of silver halide may be reduced to at most 10 mole % or at most 5 mole %. Particularly, the use of an emulsion having a silver bromide content of 1 mole % or less which is almost pure silver chloride is preferred since it makes the color developing process more rapid.

The photographic emulsion layer of the color negative films as used herein may contain any of the following silver halides: silver bromide, silver iodobromide, silver iodochlorobromide, silver chlorobromide and silver chloride. Preferred are silver iodobromide and silver iodochlorobromide having a silver iodide content of not more than 30 mole %. The most preferred are silver iodobromides having a silver iodide content of 2 to 25 mole %.

Use of flat grains in the silver halide photographic emulsion used in the invention may provide enhanced sensitivity including improvement in efficiency of color sensitization by sensitizing dyes, improved relation between sensitivity and graininess, improved sharpness, improvement in progress of development, improved covering power and improved cross-over.

The term "flat silver halide grain" as used herein means silver halide grains having a ratio of diameter to thickness of 5 or more, such as more than 8 or between 5 and 8.

The term "diameter of silver halide grain" herein used means a diameter of circle which has the same area as the projected area of grain. In the present invention, the diameter of the flat silver halide grains is 0.3 to 5.0 microns, preferably 0.5 to 3.0 microns.

The thickness thereof is 0.4 microns or less, preferably 0.3 microns or less, more preferably 0.2 microns or less.

Generally, a flat silver halide grain is a disc-like grain having two surfaces parallel to each other. Accordingly, the aforementioned "thickness" is expressed as the distance between the two parallel surfaces constituting a flat silver halide grain.

Flat silver halide grains in which the grain size and/or thickness thereof are made monodisperse may be used as described in Japanese Patent Publication No. 47-11386.

Monodispersion of flat silver halide grains mentioned above means a dispersion system in which 95% of the grains dispersed therein have a grain size falling within the range of the number average grain size +60%, preferably +40%. The term "number average grain size" herein means the number average diameter of the projected area of silver halide grains.

The flat silver halide grains contained in the emulsion used in the invention preferably account for 50% or more of the total projected area, more preferably 70% or more, particularly 90% or more.

Preferred flat silver halide is comprised of silver bromide, silver iodobromide, silver chlorobromide, silver chloroiodobromide, silver chloride or silver iodochloride. Silver iodochloride is particularly preferred in high speed photosensitive materials. In the case of silver iodochloride, the content of silver iodide is usually 40 mole % or less, preferably 20 mole % or less, more preferably 15 mole % or less. In addition, silver chlorobromide and silver bromide are particularly preferred in the case of photosensitive materials for print.

The flat grains may have homogeneous composition or may be composed of two or more phases of different halogen compositions.

Various color couplers may be incorporated in the photosensitive materials used in the present invention. The term "color coupler" herein used means a compound capable of forming a dye through a coupling reaction with an oxidized form of an aromatic primary amine developing agent. Typical examples of useful color couplers include naphthol or phenol type compounds, pyrazolone or pyrazoloazole type compounds, and linear or haterocyclic ketomethylene compounds. These cyan, magenta and yellow color couplers usable in the present invention are disclosed in the patents cited in Research Disclosure, 17643 (December, 1978) VII-D; and 18717 (November, 1979).

The color couplers incorporated in the photosensitive materials are preferably made nondiffusible by imparting thereto ballast groups or polymerizing them. 2-Equivalent couplers which are substituted with coupling elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through a coupling reaction or couplers which release a development accelerator may also be used.

A typical yellow coupler capable of being used in the present invention is an acylacetamide coupler of an oil protect type. Examples of such are disclosed in U.S. Pat. Nos. 2,407,210; 2,875,057; and 3,265,506. 2-Equivalent yellow couplers are preferably used in the present invention. Typical examples of such are the yellow couplers of an oxygen atom elimination type described in U.S. Pat. Nos. 3,408,194; 3,447,928; 3,933,501; and 4,022,620, or the yellow couplers of a nitrogen atom elimination type described in Japanese Patent Publication No. 58-10739, U.S. Pat. Nos. 4,401,752 and 4,326,024, Research Disclosure (RD) 18053 (April, 1979), U.K. Patent No. 1,425,020, DEOS Nos. 2,219,917; 2,261,361; 2,329,587; and 2,433,812. Alphapivaloyl acetanilide type couplers are excellent in fastness, particularly light fastness, of formed dye. Alphabenzoyl acetanilide type couplers yield high color density.

Magenta couplers usable in the present invention include couples of an oil protect type of indazolone, cyanoacetyl, or, preferably pyrazoloazole such as 5-pyrazolone pyrazolotriazole type ones. Among 5-pyrazolone type couplers, couplers whose 3-position is substituted with an arylamino or acylamino group are preferred from the viewpoint of color phase and color density of the formed dye. Typical examples of such are described in U.S. Pat. Nos. 2,311,082; 2,343,701; 2,600,788; 2,908,573; 3,062,653; 3,152,896; and 3,936,015. An elimination group of the 2-equivalent 5-pyrazolone type couplers is preferably a nitrogen atom eliminating group described in U.S. Pat. No. 4,310,619 and arylthio group described in U.S. Pat. No. 4,351,897. The 5-pyrazolone type coupler having ballast groups described in European Patent No. 73,636 provides high color density.

As examples of the pyrazoloazole type couplers, there can be named pyrazolobenzimidazoles described in U.S. Pat. No. 3,061,432, preferably pyrazole (5,1-c) (1,2,4) triazoles described in U.S. Pat. No. 3,725,067, pyrazolotetrazoles described in Research Disclosure 24220 (June, 1984) and Japanese Patent Un-examined Publication No. 50-33552, and pyrazolopyrazoles described in Research Disclosure 24230 (June, 1984) and Japanese Patent Un-examined Publication No. 60-43659. Imidazo (1,2-b) pyrazoles described in U.S. Pat. No. 4,500,630 is preferred on account of small yellow minor absorption of formed dye and fastness. Pyrazolo (1,5-b) (1,2,4) triazole described in U.S. Pat. No. 4,540,654 is particularly preferred.

Cyan couplers usable in the present invention include naphthol or phenol couplers of an oil protect type. Typical naphthol type couplers are described in U.S. Pat. No. 2,474,293. Typical preferred 2-equivalent naphtholic couplers of oxygen atom elimination type are described in U.S. Pat. Nos. 4,052,212; 4,146,396; 4,228,233; and 4,296,200. Exemplary phenol type couplers are described in U.S. Pat. Nos. 2,369,929; 2,801,171; 2,772,162; and 2,895,826.

Cyan couplers which are resistant to humidity and heat are preferably used in the present invention. Examples of such couplers are phenol type cyan couplers having an alkyl group higher than a methyl group at a metha-position of a phenolic nucleus as described in U.S. Pat. No. 3,772,002; 2,5-diacylaminosubstituted phenol type couplers as described in U.S. Pat. Nos. 2,772,162; 3,758,308; 4,126,396; 4,334,011; and 4,327,173; DEOS No. 3,329,729; and European Patent No. 121,365; and phenol type couplers having a phenylureido group at the 2-position and an acylamino group at the 5-position as described in U.S. Pat. Nos. 3,446,622; 4,333,999; 4,451,559; and 4,427,767. Cyan couplers in which the 5-position of naphthol is substituted with a sulfonamide or amide group as described in Japanese Patent Un-examined Publication No. 60-237448, and Japanese Patent Application Nos. 59-264277 and 59-268135 are excellent in fastness of formed images and may also be preferably used in the present invention.

In order to compensate for unnecessary absorption in the short-wave region of dye formed from magenta and cyan couplers, it is preferred to use a colored coupler together in color photosensitive materials used for taking photographs. Examples of such are the yellow colored magenta couplers described in U.S. Pat. No. 4,163,670 and Japanese Patent Publication No. 57-39413, and the magenta colored cyan couplers described in U.S. Pat. Nos. 4,004,929 and 4,138,258, and U.K. Patent No. 1,146,368.

The photosensitive materials which may be employed in the present invention may further contain antioxidants, coloring enhancing agents, ultraviolet (UV) absorbers, discoloration resistant agents for cyan, magenta and/or yellow dye images, color mixing inhibitors, stain resistant agents, antifoggants, spectral sensitizers, dyes, hardening agents, surfactants, antistatic agents, development accelerators and desilvering accelerators.

The method according to the present invention can be adopted to process photosensitive materials comprised of the foregoing components and having a variety of known constructions of layers. Preferred layer construction are listed below, in which as the substrate, there may be mentioned, for instance, flexible substrates such as plastic films, paper and cloths; and rigid substrates such as glass, porcelain and metals. Among them, preferred are baryta paper and paper laminated with polyethylene film in which a white pigment such as titanium oxide and/or a bluing dye such as Ultramarine Blue are incorporated. Examples thereof are those disclosed in Research Disclosure No. 17643, pp. 23–27 and ibid, No. 18716, pp. 648–650.

(i) substrate-BL-MC-GL-MC-RL-PC(2)-PC(1);
(ii) substrate-BL-MC-RL-MC-GL-PC(2)-PC(1);
(iii) substrate-RL-MC-GL-MC-BL-PC(2)-PC(1);
(iv) substrate-RL-MC-BL-MC-GL-PC(2)-PC(1);
(v) substrate-BL(2)-BL(1)-MC-GL(2)-GL(1)-MC-RL(2)-RL(1) -PC(2)-PC(1).

Wherein PC(1) and PC(2) represent non-photosensitive layers, MC an intermediate layer, BL a blue-sensitive emulsion layer, GL a green-sensitive emulsion layer and RL a red-sensitive emulsion layer, respectively.

The method according to the present invention as explained above may effectively be carried out using an apparatus for processing silver halide photosensitive materials. A preferred embodiment of such an apparatus is shown in FIG. 1.

As seen from FIG. 1, the apparatus mainly comprises a bath $L_1$ for color development, a bath $L_2$ for bleaching and fixing, a first water washing bath $T_1$, a second water washing bath $T_2$, a third water washing bath $T_3$, devices $UV_1$ and $UV_2$ for emitting ultraviolet rays, an auxiliary tank A and a pump P. The replenishing water is supplied from the auxiliary tank A to the third water washing bath $T_3$ through the pump P. Moreover, a cascade exhaust pipe K is disposed between every two water washing baths.

Heretofore, it has been known that the formation of precipitations such as calcium carbonate can be prevented by softening hard water. However, the effects of the present invention can be reliably achieved by softening hard water as well as by restricting the amount of replenishing water to a specific range and further adding a specific chelating agent. Therefore, these effects result from the synergistic action of these three factors and have never been expected from the aforesaid known fact.

In other words, according to the method of this invention, the concentration of calcium and magnesium in the final water washing bath among a plurality of water washing baths is limited to not more than 5 mg/l, consequently that in the two preceding baths are also limited to not more than 5 mg/l and these ions are thus converted to complexes with the coexisting chelating agent. The combination of the resultant reduction in the concentration of calcium and magnesium in water washing baths and the restricted amount of replenishing water to the washing process which is 2 to 50 times the volume of carry over from the preceding bath provides unexpected effects such that the proliferation of bacteria and molds in the washing baths is positively suppressed and their proliferation on the processed color photosensitive materials is also restricted substantially.

The method for processing color silver halide photosensitive materials according to the present invention will hereunder be explained in more detail with reference to the following non-limitative working examples and the effects practically attained will also be discussed in comparison with comparative examples.

EXAMPLE 1

A multilayered color photographic paper having a layer structure as disclosed in the following Table I was prepared on a paper substrate, both surfaces of which were laminated with polyethylene films. Each coating liquid was prepared according to the following procedures:

Preparation of Coating Liquid for 1st Layer

To 19.1 g of an yellow coupler (a) and 4.4 g of a dye image stabilizer (b) there were added 27.2 ml of ethyl acetate and 7.9 ml of solvent and the resultant solution was dispersed in 185 ml of 10% aqueous gelatin solution containing 8 ml of 10% sodium dodecylbenzenesulfonate solution to form an emulsion. On the other hand, 90 g of a blue-sensitive emulsion was prepared by adding the following blue-sensitive sensitizing dye to a silver chlorobromide emulsion (silver bromide content = 1 mole %; amount of silver = 70 g/kg) in an amount of $5.0 \times 10^{-4}$ moles per mole of the silver chlorobromide.

The emulsified dispersion and the blue-sensitive emulsion prepared above were mixed and the concentration of gelatin was adjusted so as to obtain the composition described in Table I and thus the coating liquid for 1st layer was prepared.

Coating liquids for second to seventh layers were also prepared according to procedures similar to those for preparing the liquid for 1st layer. In each of these layers, sodium salt of 1-oxy-3,5-dichloro-S-triazine was used as a hardening agent for gelatin.

The following spectral sensitizers were used in each of the emulsions:

Blue-sensitive Emulsion Layer

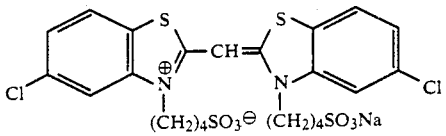

(Amount added = $5.0 \times 10^{-4}$ moles per mole of silver halide)

Green-sensitive Emulsion Layer

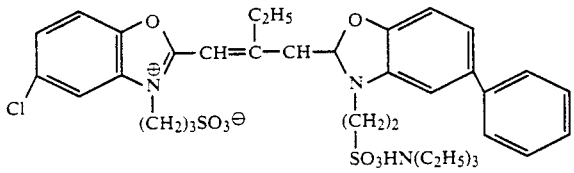

-continued (Amount added = $4.0 \times 10^{-4}$ moles per mole of silver halide)

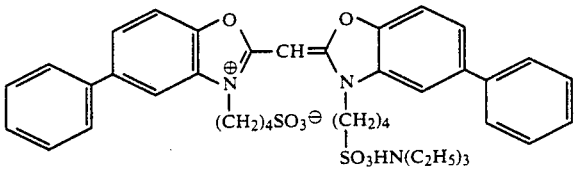

(Amount added = $7.0 \times 10^{-5}$ moles per mole of silver halide)

Red-sensitive Emulsion Layer

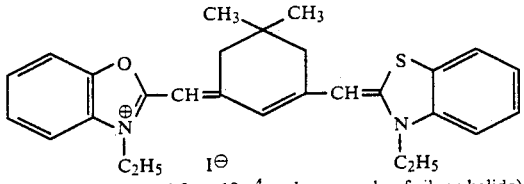

(Amount added = $1.0 \times 10^{-4}$ mole per mole of silver halide)

The following dyes were used in each of the emulsions as an irradiation resistant dye:

Green-sensitive Emulsion Layer

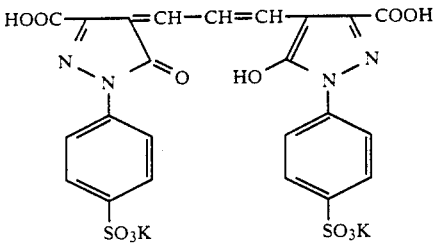

Red-sensitive Emulsion Layer

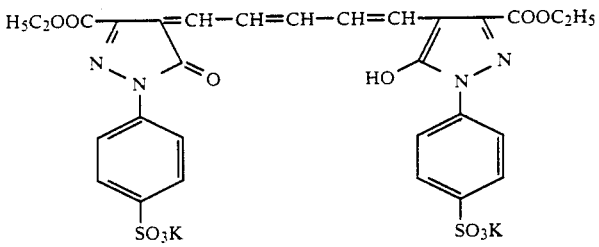

The structural formula of the compounds such as couplers used in this example were as follows:

(a) Yellow Coupler

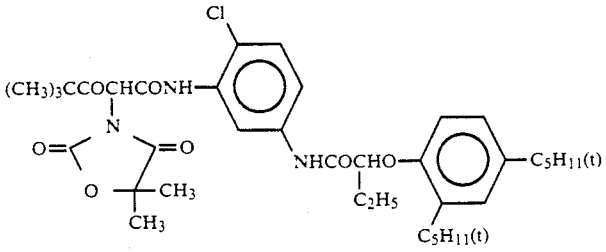

(b) Dye Image Stabilizer

-continued
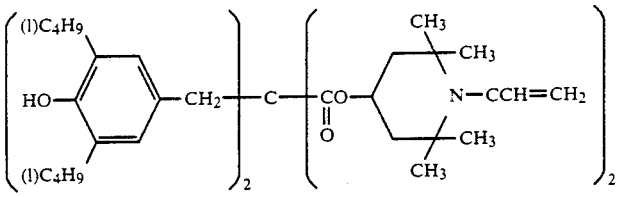
(c) Solvent
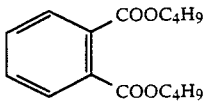
(d)
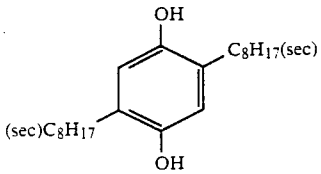
(e) Magenta Coupler
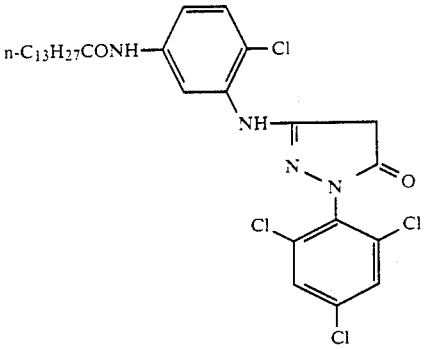
(f) Dye Image Stabilizer
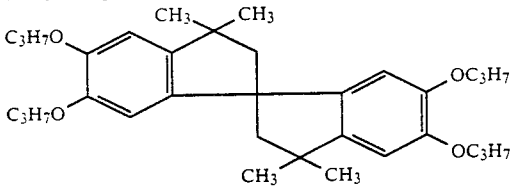
(g) Solvent
$(C_8H_{17}O)_3-P=O$ and (
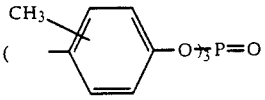
(g1) (g2)
(2:1 mixture (weight ratio))
(h) Ultraviolet Absorber
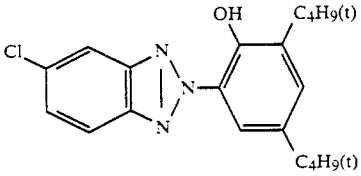
(h1)

-continued
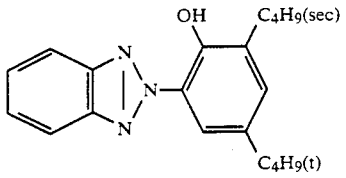
($h_2$)
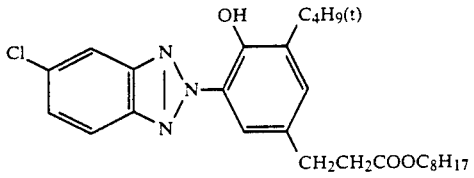
($h_3$)
(1:5:3 mixture (molar ratio))
(i) Color Mixing Inhibitor
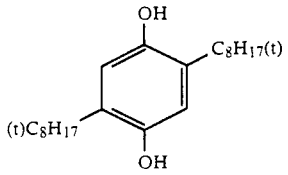
(j) Solvent
$(iso\text{-}C_9H_{18}O)_3P{=}O$
(k) Cyan Coupler
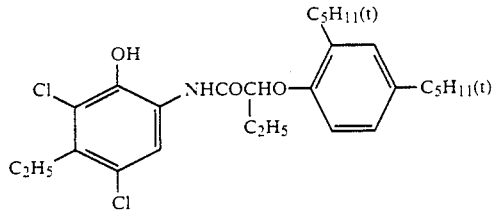
($k_1$)
and
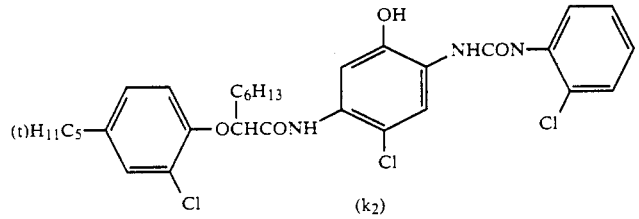
($k_2$)
(1:1 mixture (molar ratio))
(l) Dye Image Stabilizer
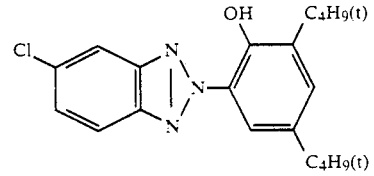
($l_1$)

-continued

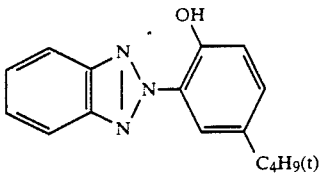

(l2)

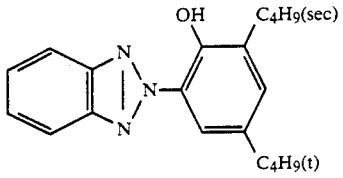

(l3)

(1:3:3 mixture (molar ratio))

(m) Solvent

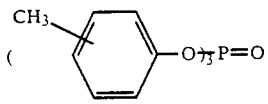

TABLE 1

| Layers | Principal composition | Amount used |
|---|---|---|
| 7th layer (Protective layer) | gelatin | 1.50 g/m$^2$ |
| 6th layer (UV absorbing layer) | gelatin | 0.54 g/m$^2$ |
| | UV absorber (h) | 0.21 g/m$^2$ |
| | solvent (j) | 0.09 cc/m$^2$ |
| 5th layer (Red-sensitive layer) | silver chlorobromide (AgBr: 1 mole %) Ag: | 0.26 g/m$^2$ |
| | gelatin | 0.98 g/m$^2$ |
| | cyan coupler (k) | 0.38 g/m$^2$ |
| | dye image stabilizer (l) | 0.17 g/m$^2$ |
| | solvent (m) | 0.23 cc/m$^2$ |
| 4th layer (UV absorbing layer) | gelatin | 1.60 g/m$^2$ |
| | UV absorber (h) | 0.62 g/m$^2$ |
| | color mixing inhibitor (i) | 0.05 g/m$^2$ |
| | solvent (j) | 0.26 cc/m$^2$ |
| 3rd layer (Green-sensitive layer) | silver chlorobromide (AgBr: 1 mole %) Ag: | 0.30 g/m$^2$ |
| | gelatin | 1.80 g/m$^2$ |
| | magenta coupler (e) | 0.34 g/m$^2$ |
| | dye image stabilizer (f) | 0.20 g/m$^2$ |
| | solvent (g) | 0.68 cc/m$^2$ |
| 2nd layer (Color mixing inhibiting layer) | gelatin | 0.99 g/m$^2$ |
| | color mixing inhibitor (d) | 0.08 g/m$^2$ |
| 1st layer (Blue-sensitive layer) | silver chlorobromide (AgBr: 1 mole %) Ag: | 0.30 g/m$^2$ |
| | gelatin | 1.86 g/m$^2$ |
| | yellow coupler (a) | 0.82 g/m$^2$ |
| | dye image stabilizer (b) | 0.19 g/m$^2$ |
| | solvent (c) | 0.34 cc/m$^2$ |
| Substrate | paper laminated with polyethylene (polyethylene situated at the side of 1st layer contains a white pigment ($TiO_2$) and a bluing dye (Ultramarine Blue)) | |

The photographic paper thus prepared was cut into long band-like papers 82.5 mm in width, which were exposed to light by an autoprinter and then processed by an autodeveloping machine according to each of the following processing steps shown in Table II.

In the above processing, the amount of the bleaching-fixing liquid carried over in the washing bath (1) by the processed color photographic paper from the bleaching-fixing bath was 2.5 ml per unit length (1 m) of the photographic paper (82.5 mm in width) and the amount of washing water replenished was 6 times of the amount of bleaching-fixing liquid carried over.

TABLE II

| Step | Processing Steps: Temp. (°C.) | Processing time (sec.) | Volume of tank (liter) | Amount Replenished* |
|---|---|---|---|---|
| Color Development | 35 | 45 | 16 | 13 ml |
| Bleaching-Fixing | 35 | 45 | 10 | 8 ml |
| Water Washing (1) | 35 | 20 | 4 | Multistage and counter-current system |
| Water Washing (2) | 35 | 20 | 4 | |
| Water Washing(3) | 35 | 20 | 4 | |
| Water Washing (4) | 35 | 30 | 4 | 15 ml |

The processing liquids used in these steps had the following compositions:

| Component | Mother Liquor | Replenishing Solution |
|---|---|---|
| (Color Development Solution) | | |
| Water | 800 ml | 800 ml |
| 1-Hydroxyethylidene-1,1-diphosphonic acid (60% solution) | 1.5 ml | 1.5 ml |
| Lithium Chloride | 1.0 g | 1.0 g |
| Diethylenetriaminepentaacetic acid | 1 g | 1 g |
| 4,5-Dihydroxy-m-benzenediphosphonic acid | 1.0 g | 1.5 g |
| Sodium Sulfite | 0.5 g | 1.0 g |
| Potassium Bromide | 0.1 g | — |
| Sodium Chloride | 1.5 g | — |
| Adenin | 30 mg | 60 mg |
| Potassium Carbonate | 40 g | 40 g |
| N-Ethyl-N-(beta-methanesulfonamidethyl)-3-methyl-4-aminoaniline sulfate | 4.5 g | 11.0 g |
| Diethylhydroxylamine | 3.0 g | 4.0 g |
| Fluorescent Whitener (Whitex 4: manufactured and sold by Sumitomo Chemical Company Ltd.) | 1.0 g | 2.0 g |
| Polyethyleneimine (50% aqueous solution) | 3.0 g | 3.0 g |
| Water (Amount sufficient to obtain 1 liter of each solution) | | |

-continued

| Component | Mother Liquor | Replenishing Solution |
|---|---|---|
| pH (KOH) | 10.25 | 10.80 |
| (Bleaching-Fixing Solution) | | |
| Water | 700 ml | 700 ml |
| Ammonium Thiosulfate (70%) | 150 ml | 150 ml |
| Sodium Sulfite | 18 g | 25 g |
| Ferric Ammonium ethylene-diaminetetraacetate | 55 g | 65 g |
| Ethylenediaminetetraacetic acid | 5 g | 10 g |
| pH (Adjusted by the addition of aqueous ammonia or acetic acid) | 6.75 | 6.50 |
| Water (Amount required to obtain 1 liter of the intended solutions) | | |

Washing Water

As the washing water, the following washing waters A to H were used in this Example:

A: This was well water having the properties listed in the following Table III;

B: This was obtained by passing the washing water A through a column packed with H-type strong acidic cation exchange resin (manufactured and sold under the trade name of Diaion SK-1B by Mitsubishi Chemical Industries Ltd.) and OH-type strong basic anion exchange resin (manufactured and sold under the trade name of Diaion SA-10A by Mitsubishi Chemical Industries Ltd.) to desalt the washing water A, which has properties as listed in Table III;

C: This was prepared by adding $1\times10^{-3}$ mole/l of EDTA to the washing water A and adjusting the pH thereof to 7.0 with the addition of sodium hydroxide; and D to H: These were prepared by adding to the washing water B, the respective chelating agents shown in Table IV in an amount of $1\times10^{-3}$ mole/l and adjusting the pH thereof to 7.0 with sodium hydroxide respectively.

TABLE III

| | Properties of Washing Water | |
|---|---|---|
| | Washing Water A | Washing Water B |
| pH | 7.5 | 7.6 |
| Calcium Ions | 23 mg/l | 1.3 mg/l |
| Magnesium Ions | 10 mg/l | 0.4 mg/l |
| Chlorine Ions | 30 mg/l | 3.2 mg/l |
| Residue After Evaporation | 142 mg/l | 16.0 mg/l |

The processing was carried out at a rate of 180 m/day and such processing was repeated for 6 days (at a rate of 8 hours/day) using each of the foregoing washing water A to H. In general, molds tended to proliferate in water contained in the final water washing bath when the autodeveloper was stopped and the proliferated molds adhered to the print when the autodeveloper was again started, forming spot-like stains. After processing for 6 days, the autodeveloper was stopped and left to stand for 20 days in a room maintained at a temperature of about 25° C. and thereafter water in the final water washing bath was examined on turbidity and the degree of proliferation of molds therein on the basis of the following standard:

| | Turbidity | Mold |
|---|---|---|
| (−) | not observed | not observed |
| (−) | observed but in small degree | observed but in small extent |
| (++) | observed in some degree | observed in some extent |
| (+++) | observed in great degree | observed in great extent |

In this connection, the turbidity was determined from visual observation and absorbance at 700 nm (optical path = 10 mm). On the other hand, the proliferation of mold was estimated according to visual observation.

The results obtained and chelating agents used are summarized in the following Table IV. In this Table IV, the stability constant of each of the chelating agents used are as follows:

| | Stability Constant Ca | Mg |
|---|---|---|
| Iminodiacetic Acid (IA) | 2.59 | 2.94 |
| Nitrilotriacetic Acid (NA) | 6.41 | 5.46 |
| Ethylenediaminetetraacetic Acid (EDTA) | 10.85 | 8.69 |
| 1,2-Diaminopropanetetraacetic Acid (DPA) | 11.47 | 10.29 |
| Cyclohexanediaminetetraacetic Acid (CDA) | 12.08 | 10.32 |

TABLE IV

| | Washing Water | Chelating Agent | Turbidity Absorbance | V. Obs. | Mold (V. Obs.) |
|---|---|---|---|---|---|
| Comp. Ex. | A | — | 0.036 | (+++) | (+++) |
| | B | — | 0.010 | (+) | (+) |
| | C | EDTA | 0.041 | (+++) | (++) |
| | D | IA | 0.012 | (+) | (++) |
| | E | NA | 0.013 | (+) | (++) |
| Present Invention | F | EDTA | 0.001 | (−) | (−) |
| | G | DPA | 0.001 | (−) | (−) |
| | H | CDA | 0.002 | (−) | (−) |

As seen from the results shown in Table IV, it is clear that the increase in turbidity and the proliferation of mold can surely be prevented for a long period of time by lowering the concentration of both calcium and magnesium in the washing water to not more than 5 mg/l as well as adding a specific chelating agent thereto.

The basic molecular structure of Diaion SK-1B available from Mitsubishi Chemical Industries Ltd. is as follows:

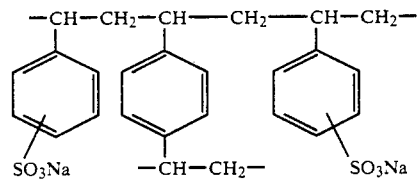

EXAMPLE 2

The following four kinds of color photographic paper P1 to P4 were prepared:

Color Photographic Paper P1: Color photographic paper described in Table I of Example 1.

Color Photographic Paper P2: Similar to the color photographic paper P1 except that the 7th layer had the following composition:

| | |
|---|---|
| Gelatin | 1.33 g/m$^2$ |
| Acrylic acid modified polyvinyl alcohol copolymer (degree of modification = 17%) | 0.17 g/m$^2$ |

Color Photographic Paper P3: Color photographic paper having a layer structure and composition of each layer shown in Table V.

Color Photographic Paper P4: Similar to the color photographic paper P3 except that the 7th layer had the following composition:

| | |
|---|---|
| Gelatin | 1.46 g/m$^2$ |
| Acrylic acid modified polyvinyl alcohol copolymer (degree of modification = 17%) | 0.17 g/m$^2$ |

Table V

| Layer | Principal Composition | Amount used (g/m$^2$) |
|---|---|---|
| 7th layer (protective layer) | Gelatin | 1.62 |
| 6th layer UV absorbing layer) | Gelatin | 1.06 |
| | VU absorber (h) | 0.35 |
| | UV absorbing solvent (c) | 0.12 |
| 5th layer (Red-sensitive layer) | Silver chlorobromide (AgBr content = 50 mole %) | 0.25 (silver) |
| | Gelatin | 1.26 |
| | Cyan coupler (k) | 0.50 |
| | Coupler solvent (c) | 0.25 |
| 4th layer (UV absorbing layer) | Gelatin | 1.60 |
| | UV absorber (h) | 0.70 |
| | Color mixing inhibitor (i) | 0.20 |
| | Solvent for color mixing inhibitor (c) | 0.30 |
| 3rd layer (Green-sensitive layer) | Silver chlorobromide (AgBr content = 70 mole %) | 0.17 (silver) |
| | Gelatin | 1.40 |
| | Magenta coupler (n) | 0.40 |
| | Coupler solvent (g) | 0.20 |
| 2nd layer (Intermediate layer) | Gelatin | 1.10 |
| | Color mixing inhibitor (i) | 0.20 |
| | Solvent for color mixing inhibitor (c) | 0.10 |
| 1st layer (Blue-sensitive layer) | Silver chlorobromide (AgBr content = 80 mole %) | 0.35 (silver) |
| | Gelatin | 1.54 |
| | Yellow coupler (a) | 0.50 |
| | Coupler solvent (c) | 0.50 |
| Substrate | Paper laminated with polyethylene films in which the polyethylene situated at the side of 1st layer contains a white pigment (such as $TiO_2$) and a bluing dye such as Ultramarine Blue. | |

Magenta coupler (n)

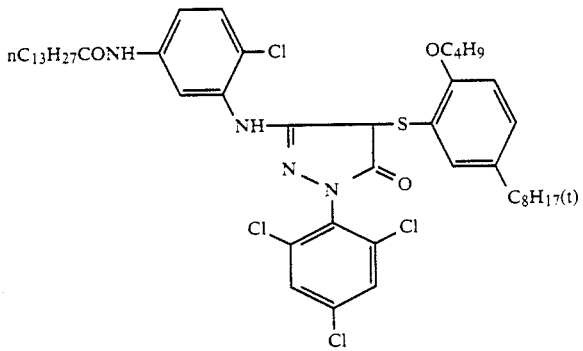

In addition to the foregoing compounds, the same spectral sensitizers as in Example 1 were used. After exposing the color photographic paper P1 (82.5 mm in width) to light utilizing an autoprinter, it was processed by an autodeveloping machine according to processing (I) shown in Table VI. In the processing (I), five kinds of water washing procedures inclusive of the present invention were conducted and the results obtained were compared with each other. In this connection, a color development solution and a bleaching-fixing solution used in this processing are the same as used in Example 1.

TABLE VI

| Steps of the Processing (I) | | | | |
|---|---|---|---|---|
| Step | Temp. (°C.) | Processing time (sec.) | Volume of tank (liter) | Amount Replenished* |
| Color Development | 35 | 45 | 16 | 13 ml |
| Bleaching-Fixing | 35 | 45 | 10 | 8 ml |
| Water Washing (1) | 35 | 20 | 3.5 | Multistage and counter-current system: The amount replenished was given below. |
| Water Washing (2) | 35 | 20 | 3.5 | |
| Water Washing (3) | 35 | 20 | 3.5 | |

Water Washing Process A

Comparative Example

Tap water having the following properties was replenished in an amount 30 ml per unit length (1 m) of the color photographic paper.

| | |
|---|---|
| pH | 7.3 |
| Calcium Ions | 36 mg/l |
| Magnesium Ions | 14 mg/l |

Water Washing Process B

Comparative Example

Washing water comprises the same tap water as in the water washing process A and 5-chloro-2-methyl-4-isothiazolin-3-one disclosed in Japanese Patent Un-examined Publication No. 57-8542 as a mold control agent and suspending agent in an amount of 0.5 g per liter of tap water and the resultant washing water was replenished at a rate of 30 ml per unit length (1 m) of the color photographic paper.

Water Washing Process C

Present Invention

Tap water similar to that used in the water washing process A was treated with Na-type strong acidic cation exchange resin (manufactured and sold under the trade name of Diaion SK-1B by Mitsubishi Chemical Industries Ltd.) to obtain washing water having the following properties and then EDTA was added thereto in an amount of $1\times10^{-3}$ mole/l and the pH was adjusted to 7.0 with NaOH. The washing water was replenished in an amount of 30 ml per 1 m of the color photographic paper.

| | |
|---|---|
| pH | 7.4 |

-continued

| | |
|---|---|
| Calcium Ions | 1.5 mg/l |
| Magnesium Ions | 0.6 mg/l |

Water Washing Process D

Present Invention

This was similar to that described in the water washing process C except that methyl-EDTA was used instead of EDTA.

Water Washing Process E

As shown in FIG. 1, UV lamps having a rated consumed power of 0.5 W (low pressure mercury vapor discharge tube) were disposed to a water storage tank for replenishing and a final water washing bath. On the other hand, the same washing water as in the water washing process C was used and the replenishing was carried out so that the washing water stored in the storage tank was replenished at a rate of 30 ml per 1 m of the color photographic paper. Under such conditions, the processing was carried out while the UV lamps were switched on during operating the autodeveloper.

In the processing methods including the water washing processes A to E, the color photographic paper P1 of 82.5 mm in width was processed at a rate of 180 m per day for 7 days and then the processing was interrupted for 7 days. Thereafter, the conditions (turbidity and presence of mold) of each of the water washing bath and calcium and magnesium concentration of the washing water contained in the final water washing bath were determined. Then, the color photographic paper P1 as well as P2 were further processed by the same procedures and baths to determine the degree of contamination (stains and deposition of mold or the like on the processed photographic paper) as well as the adhesion properties thereof when two sheets of the processed photographic paper were superposed. The concentration of calcium and magnesium were determined according to atomic absorption spectroscopy.

Furthermore, in a processing (II) as shown in Table VII in which the color photographic paper P3 was employed, results obtained were compared between the water washing process A to E. The processing (II) was identical to the processing (I) except for utilizing the following processing steps and color developing solution having the following composition.

In the above processing, the amount of the bleaching-fixing liquid carried over in the washing bath ① by the processed color photographic paper from the bleaching-fixing bath was 3 ml per unit length (1 m) of the photographic paper (82.5 mm in width) and the amount of washing water replenished was 10 times of the amount of bleaching-fixing liquid carried over.

TABLE VII

| Steps in the Processing (II) | | | | |
|---|---|---|---|---|
| Step | Temp. (°C.) | Processing time (sec.) | Volume of tank (liter) | Amount Replenished* |
| Color Development | 38 | 1 min. 40 sec. | 16 | 24 ml |
| Bleaching-Fixing | 33 | 1 min. | 10 | 13 ml |
| Water Washing (1) | 33 | 20 | 3.5 | Multistage and counter-current system: The amount replenished was given below. |
| Water Washing (2) | 33 | 20 | 3.5 | |
| Water Washing (3) | 33 | 20 | 3.5 | |

(Color Developing Solution for the Processing (II))

| Component | Mother Liquor | Replenishing Solution |
|---|---|---|
| Water | 800 ml | 800 ml |
| 1-Hydroxyethylidene-1,1-diphosphonic acid (60% solution) | 1.5 ml | 1.5 ml |
| Diethylenetriaminepentaacetic acid | 1.0 g | 1.0 g |
| Benzyl alcohol | 16 ml | 20 ml |
| Diethylene glycol | 10 ml | 10 ml |
| Sodium sulfite | 2.0 g | 2.5 g |
| Hydroxylamino sulfite | 3.0 g | 3.5 g |
| Potassium bromide | 1.0 g | — |
| Sodium carbonate | 30 g | 35 g |
| N-Ethyl-N-(beta-methanesulfonamidethyl)-3-methyl-4-aminoaniline sulfate | 6.0 g | 8.0 g |
| Water (Amount required to form 1000 ml of the intended solutions) | | |
| pH | 10.25 | 10.60 |

After carrying out the processing of color photographic paper P3 for 6 days followed by interrupting the processing over 4 days, the color photographic paper P3 and P4 were further processed to effect estimation of the same properties as before. All the results obtained are listed in the following Table VIII.

TABLE VIII

| No. | Processing | Water Washing Process | Concn. in the Final Water Washing Bath Ca (mg/l) | Mg (mg/l) |
|---|---|---|---|---|
| 1* | (I) | A | 40 | 13 |
| 2* | (I) | B | 29 | 13 |
| 3 | (I) | C | 2.0 | 0.9 |
| 4 | (I) | D | 2.1 | 1.0 |
| 5 | (I) | E | 2.0 | 0.9 |
| 6* | (II) | A | 28 | 14 |
| 7* | (II) | B | 28 | 13 |
| 8 | (II) | C | 2.3 | 1.0 |
| 9 | (II) | D | 1.9 | 0.8 |
| 10 | (II) | E | 2.2 | 1.0 |

| No. | Conditions of Liquid in each Water Washing Bath: Turbidity: Color of Solution | Proliferation of Mold | Color Photographic Paper | Contaminant | Adhesion Properties |
|---|---|---|---|---|---|
| 1* | (++) | (+++) | P1 | (++) | (+) |
| | | | P2 | (+) | (+) |
| 2* | (++) colored blank | (−) | P1 | (++) | (+++) |
| | | | P2 | (+) | (+++) |
| 3 | (−) | (+) | P1 | (−) | (+) |
| | | | P2 | (−) | (−) |
| 4 | (−) | (−) | P1 | (−) | (+) |
| | | | P2 | (−) | (−) |
| 5 | (−) | (−) | P1 | (−) | (+) |
| | | | P2 | (−) | (−) |
| 6* | (+++) | (+++) | P3 | (+++) | (++) |
| | | | P4 | (++) | (++) |
| 7* | (+++) colored blank | (+) | P3 | (+++) | (+++) |
| | | | P4 | (++) | (+++) |
| 8 | (−) | (+) | P3 | (+++) | (+) |
| | | | P4 | (++) | (−) |
| 9 | (−) | (+) | P3 | (−) | (−) |
| | | | P4 | (−) | (−) |
| 10 | (−) | (−) | P3 | (−) | (+) |
| | | | P4 | (−) | (−) |

*This means that the corresponding processing is a comparative one.

TABLE IX

| Explanation of Ideograms Appearing in Table VIII | | | | |
|---|---|---|---|---|
| | Turbidity Color of Liquid | Proliferation of Mold | Contaminant (Stains & Deposit) | Adhesion Properties |
| (−) | not observed | not observed | not observed | not observed |
| (+) | observed in small degree | observed in small degree | observed in small degree | observed in small extent |
| (++) | observed in some degree | observed in some degree | observed in some degree | observed in some extent |
| (+++) | osberved in great degree | observed in great degree | observed in great degree | observed in great extent |

Estimation of Adhesion Properties

The adhesion properties listed in Table VIII were determined according to the following method: After exposing the whole the surface of a photographic paper, it was cut into pieces of 3.5 cm×6 cm in size followed by maintaining them in a controlled chamber held at 25° C. and a relative humidity (RH) of 80% for 2 days. Then, parts (3.5 cm×3.5 cm) of the two of them were superposed on one another, a load of 500 g was applied and they were further maintained in a controlled chamber held at 35° C. and RH of 80% for 3 days. Thereafter, they were peeled off and the surfaces superposed were observed with respect to adhesion.

As seen from the results listed in Table VIII, it is found, in the water washing process A, that the washing water has a high turbidity and is severely colored black and the photographic paper is substantially contaminated to a great degree. In addition, in the water washing process B in which 5-chloro-2-methyl-4-isothiazolin-3-one was used, the proliferation of molds is inhibited, while the washing water is colored to a great degree which in turn soaks into the photographic paper to cause severe contamination thereof and the adhesion properties are also increased.

On the contrary, it is found, according to the present invention, that the desired effects can be achieved without causing the increase of the adhesion properties. Moreover, the photographic paper P2 and P4 in which the 7th layer contains acrylic acid modified polyvinyl alcohol copolymer are very suitable for treatment according to the method for processing of the present invention because of its low adhesion properties and other good properties.

EXAMPLE 3

The instant example was carried out to explain the relationship between the effects of the present invention and the amount of the washing water used.

Color photographic paper as used in this Example was the same as that used in Example 2 i.e., the color photographic paper P2. Furthermore, the processing steps used herein were also the same as those used in Example 2 (the processing (I); see Table VI) and the processing solution were those used in the processing (I).

As washing water, tap water (A) having the following properties and that treated with ion exchange resin and containing EDTA (washing water (B)) having the following properties were used in this Example.

| Properties of the tap water used: | |
|---|---|
| pH | 6.6 |
| Ca ions | 26 mg/l |
| Mg ions | 8 mg/l |
| Properties of the washing water B used: | |
| pH | 6.8 |
| Ca ions | 1.6 mg/l |
| Mg ions | 0.3 mg/l |

The ion exchange resin used was porous-type strong acidic cation exchange resin PK-216 manufactured and sold by Mitsubishi Chemical Industries Ltd.

The details of the processing in this Example were shown in Table X.

TABLE X

| Details of the Processing | | | | | |
|---|---|---|---|---|---|
| Run. | (A)*1 (ml) | (B)*2 (ml) | (B/A) | Washing Water | Amount Processed |
| 1 | 2.5 | 400 | 160 | A | 90 m/day × 7 days |
| 2 | 2.5 | 400 | 160 | B | " |
| 3 | 2.5 | 125 | 50 | A | " |
| 4 | 2.5 | 125 | 50 | B | " |
| 5 | 2.5 | 25 | 10 | A | " |
| 6 | 2.5 | 25 | 10 | B | " |
| 7 | 2.5 | 5 | 2 | A | " |
| 8 | 2.5 | 5 | 2 | B | " |

*1(A) means "the amount of solution carried over by the treated paper from the preceding bath (A)" which was determined according to the following manner: A sample of 1 m in length was collected just before the color photographic paper during treating entered into water washing bath and immediately thereafter the sample was immersed in 1 liter of distilled water followed by maintaining it at 30° C. while stirring with a magnetic stirrer. Then, a volume of the solution was takes therefrom, quantitatively analized on the concentration of thiosulfate ions $C_1$ (g/l) contained therein, at the same time the concentration of thiosulfate ions $C_2$ (g/l) of the fixing solution in the preceding bath was also quantitatively determined and thus the amount of solution (A (ml)) carried over from the preceding bath was estimated according to the following equation:

$$C1 \times \frac{(1000 - A)}{A} = C2$$

In this connection, the quantitative determination of thiosulfate ions was carried out by acidic iodine titration after adding formaldehyde to the sample to mask the coexisting sulfite ions.

*2This is "the amount of water replenished (B)" which is expressed as the replenished amount per unit length of the sample (color photogrpahic paper).

As seen from the above, after processing for 7 days, the calcium and magnesium concentrations were determined on the washing water in the final bath (3rd bath) according to atomic absorption spectroscopy and was also examined on turbidity of water, presence or absent of deposits on the processed color photographic paper. The results thus obtained are listed in the following Table XI.

TABLE XI

| Running | Washing Water | Concn. in Final Bath Ca (mg/l) | Mg (mg/l) | B/A | Turbidity | Deposits |
|---|---|---|---|---|---|---|
| 1* | A | 36 | 14 | 160 | (−) | (−) |
| 2* | B | 1.4 | 0.5 | 160 | (−) | (−) |
| 3* | A | 25 | 14 | 50 | (+) | (+) |
| 4 | B | 1.8 | 0.6 | 50 | (−) | (−) |
| 5* | A | 24 | 10 | 10 | (+++) | (+++) |
| 6 | B | 2.0 | 0.9 | 10 | (−) | (−) |
| 7* | A | 26 | 13 | 2 | (++) | (++) |
| 8 | B | 2.0 | 1.1 | 2 | (−) | (−) |

TABLE XI-continued

Explanation of Ideograms Appearing in TABLE XI:

| | Turbidity of Washing Water | Degree of Deposition |
|---|---|---|
| (−) | not observed | no deposit |
| (+) | observed in small degree | observed in small degree |
| (++) | observed in some degree | observed in some degree |
| (+++) | observed in great degree | observed in great degree |

As seen from the results listed in Table XI, the increase in turbidity and the formation of deposits on the processed photographic paper can effectively be prevented by controlling the value B/A to 2 to 50.

EXAMPLE 4

There was prepared a multilayered color photosensitive material (hereunder referred to as Sample N1) by applying, in order, the following layers, each of which had the composition given below, on a substarate of cellulose triacetate film provided with an underlying coating.

Composition of the Photosensitive Layer

In the following composition, each component was represented by coated amount expressed as g/m$^2$, while as to silver halide, the amount was represented by coated amount expressed as a reduced amount of elemental silver, provided that the amounts of sensitizing dyes and couplers were represented by coated amount expressed as molar amount per unit mole of silver halide included in the same layer.

| (Sample N1) | |
|---|---|
| 1st layer: Halation Inhibiting Layer | |
| Black Colloidal Silver | 0.18 (silver) |
| Gelatin | 1.40 |
| 2nd Layer: Intermediate Layer | |
| 2,5-Di-tert-pentadecylhydroquinone | 0.18 |
| C-1 | 0.07 |
| C3 | 0.02 |
| U-1 | 0.08 |
| U-2 | 0.08 |
| HBS-1 | 0.10 |
| HBS-2 | 0.02 |
| Gelatin | 1.04 |
| 3rd Layer: First Red-sensitive Emulsion Layer | |
| Silver Iodobromide Emulsion (AgI content = 6 mole %; average particle size = 0.8 microns) | 0.50 (silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| C-10 | 0.0050 |
| Gelatin | 1.20 |
| 4th Layer: Second Red-sensitive Emulsion Layer | |
| Silver Iodobromide Emulsion (AgI content = 5 mole %; average grain size = 0.85 microns) | 1.15 (silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| C-10 | 0.004 |
| HBS-1 | 0.005 |
| Gelatin | 1.50 |
| 5th Layer: Third Red-sensitive Emulsion Layer | |
| Silver Iodobromide Emulsion (AgI content = 10 mole %; average grain size = 1.5 microns) | 1.50 (silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| 6th Layer: Intermediate Layer | |
| Gelatin | 1.06 |
| 7th Layer: First Green-sensitive Emulsion Layer | |
| Silver Iodobromide Emulsion (AgI content = 6 mole %; average grain size = 0.8 microns) | 0.35 (silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| C-6 | 0.120 |
| C-1 | 0.021 |
| C-7 | 0.030 |
| C-8 | 0.025 |
| HBS-1 | 0.20 |
| Gelatin | 0.70 |
| 8th Layer: Second Green-sensitive Emulsion Layer | |
| Silver Iodobromide Emulsion (AgI content = 5 mole %; average grain size = 0.85 microns) | 0.75 (silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |
| 9th Layer: Third Green-sensitive Emulsion Layer | |
| Silver Iodobromide Emulsion (AgI content = 10 mole %; average green size = 1.5 microns) | 1.80 (silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-16 | 0.012 |
| C-1 | 0.001 |
| HBS-2 | 0.69 |
| Gelatin | 1.74 |
| 10th Layer: Yellow Filter Layer | |
| Yellow Colloidal Silver | 0.05 (silver) |
| 2,5-Di-tert-pentadecylhydroquinone | 0.03 |
| Gelatin | 0.95 |
| 11th Layer: First Blue-sensitive Emulsion Layer | |
| Silver Iodobromide Emulsion (AgI content = 6 mole %; average grain size = 0.6 microns) | 0.24 (silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| 12th Layer: Second Blue-sensitive Emulsion Layer | |
| Silver Iodobromide Emulsion (AgI content = 10 mole %; average grain size = 1.0 microns) | 0.45 (silver) |
| Sensitizing Dye VIII | $2.1 \times 10^{-4}$ |

-continued

| (Sample N1) | |
|---|---|
| C-9 | 0.098 |
| HBS-1 | 0.03 |
| Gelatin | 0.46 |
| 13th Layer: Third Blue-sensitive Emulsion Layer | |
| Silver Iodobromide Emulsion (AgI content = 10 mole %; average grain size = 1.8 microns) | 0.77 (silver) |
| Sensitizing Dye VIII | $2.2 \times 10^{-4}$ |
| C-9 | 0.036 |
| HBS-1 | 0.07 |
| Gelatin | 0.69 |
| 14th Layer: First Protective Layer | |
| Silver Iodobromide Emulsion (AgI content = 1 mole %; average grain size = 0.07 microns) | 0.5 (silver) |
| U-1 | 0.11 |
| U-2 | 0.17 |
| Butyl p-hydroxybenzoate | 0.012 |
| HBS-1 | 0.90 |

-continued

| (Sample N1) | |
|---|---|
| 15th Layer: Second Protective Layer | |
| Particles of Polymethylmethacrylate (diameter = about 1.5 microns) | 0.54 |
| S-1 | 0.15 |
| S-2 | 0.10 |
| Gelatin | 0.72 |

To each of these layers, there were added a gelatin hardening agent H-1 and a surfactant in addition to the foregoing components.

(Samples N2 and N3)

These Samples N2 and N3 were prepared according to the same procedures as those for preparing Sample N1 except that C-10 used in the compositions of the third and fourth layers was replaced with C-11 and C-12 respectively.

U-1

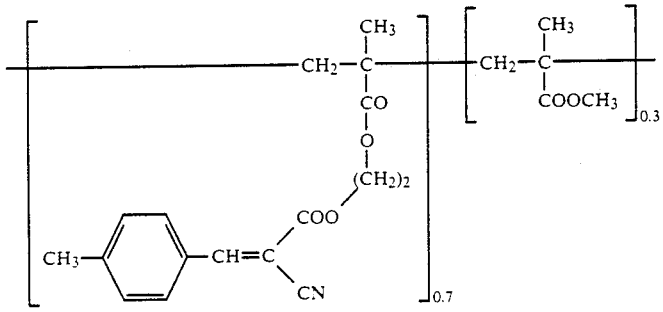

U-2

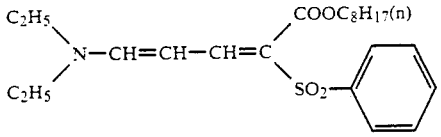

C-1

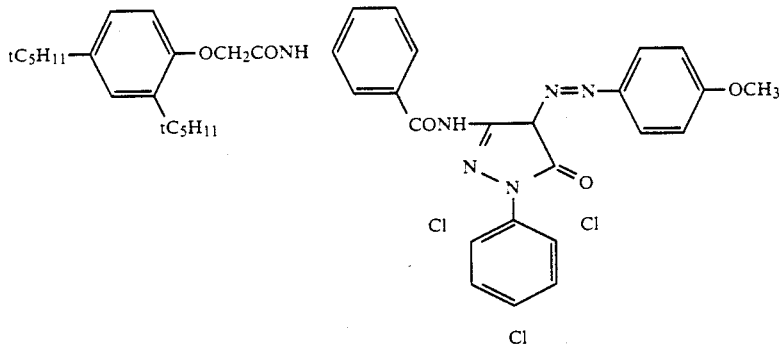

C-2

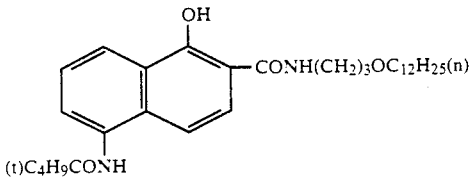

-continued
C-3
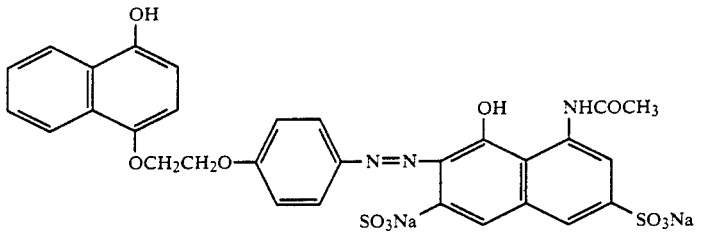
C-4
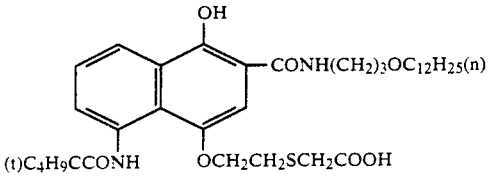
C-5
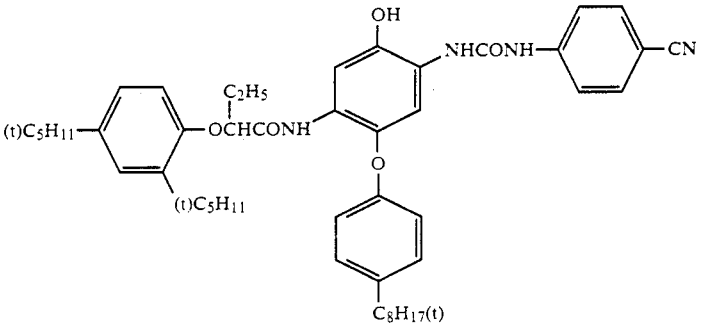
C-6
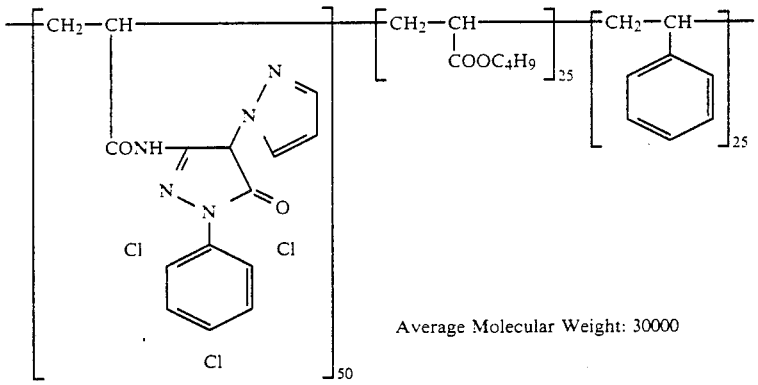
Average Molecular Weight: 30000
C-7
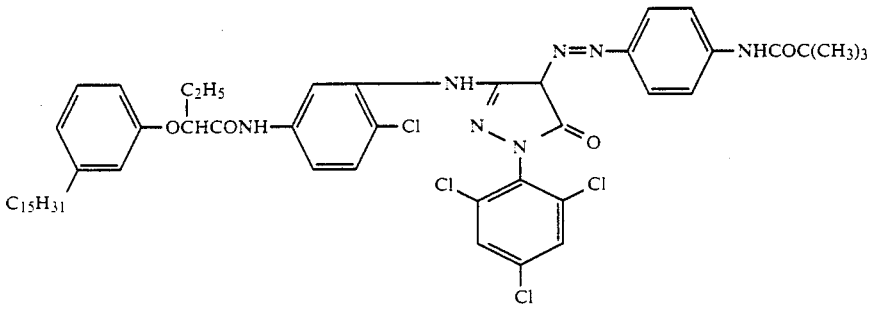
(The coupler disclosed in U.S. Pat. No. 4,477,563)

-continued
C-8
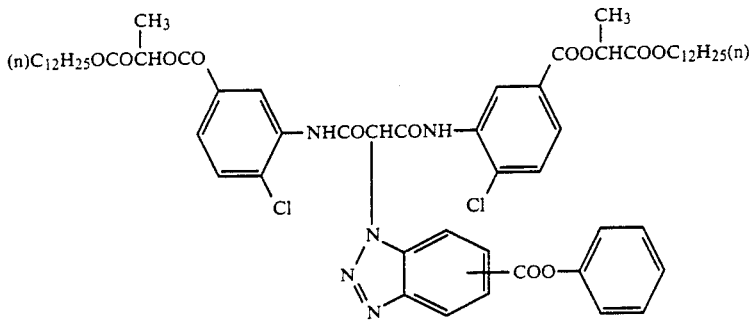
C-9
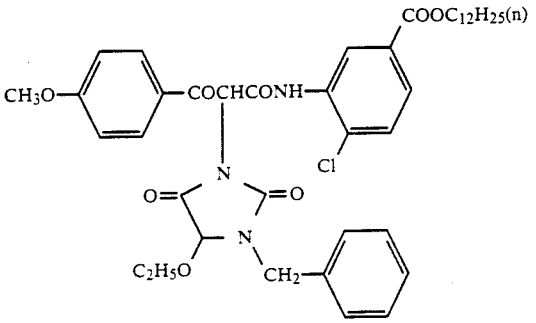
C-10
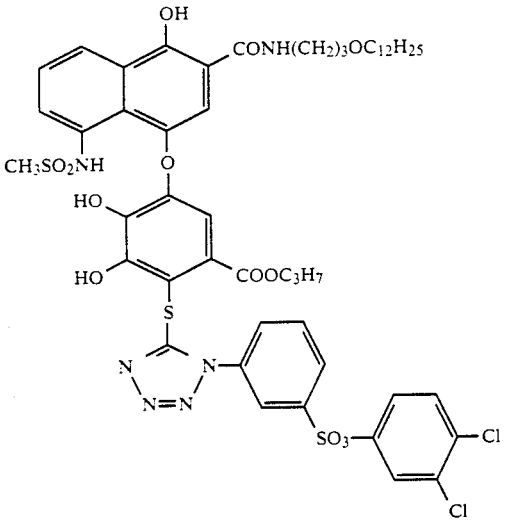
C-11
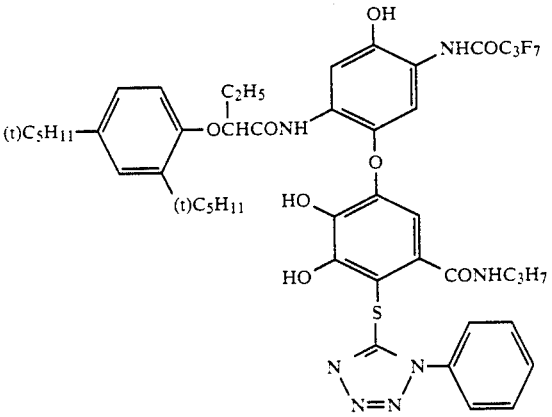
(The coupler disclosed in U.S. Pat. No. 3,227,554)

-continued
C-12
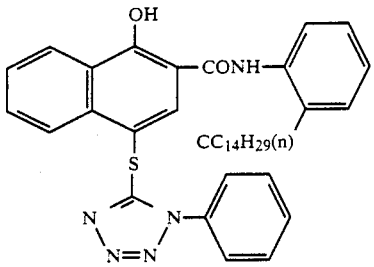
(C-13)
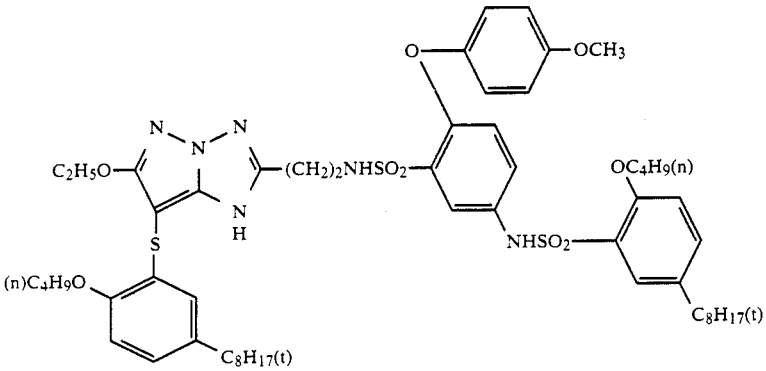
S-1
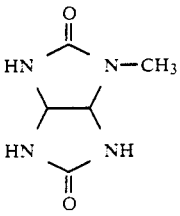
S-2
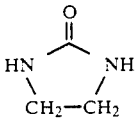
Tricredyl Phosphate HBS-1
Dibutylphthalate HBS-2
H-1
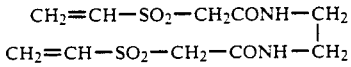
Sensitizing Dye
I
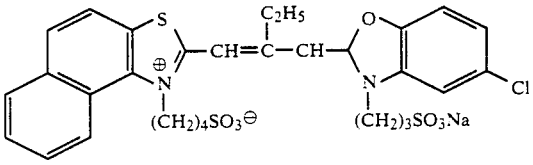
II
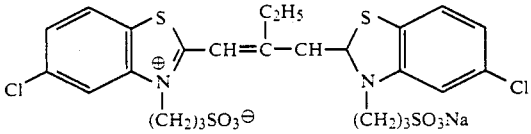

-continued

III

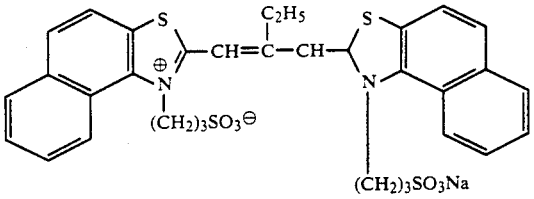

IV

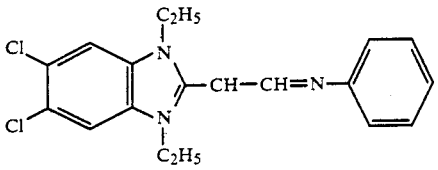

V

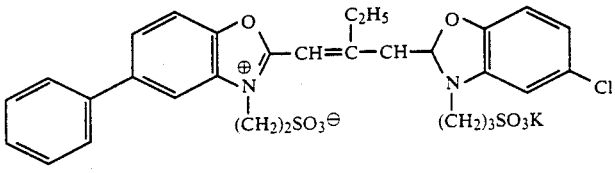

VI

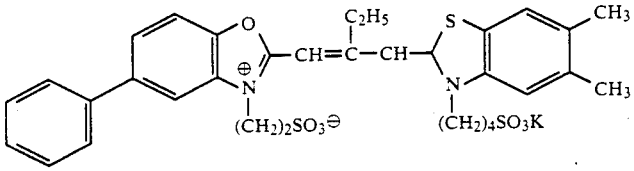

VII

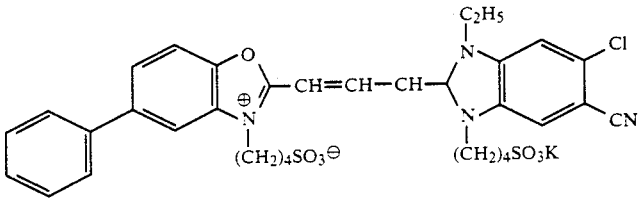

VIII

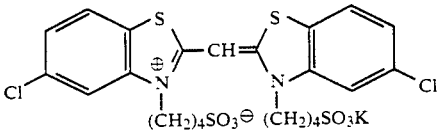

IX

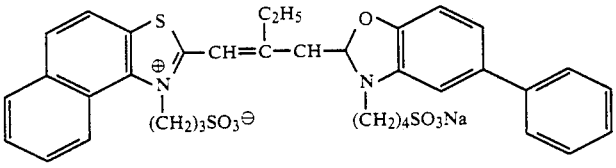

X

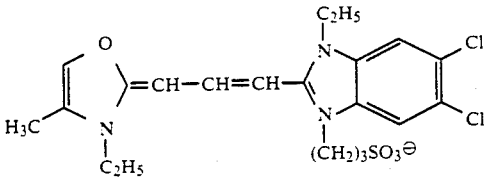

The color negative films thus prepared (Samples N1, N2 and N3) were cut into long band-like films of 35 mm in width. Then, a standard object was photographed in the open air using the color negative film (Sample N1). Thereafter, the color negative film was processed, by an autodeveloping machine, according to the processing steps shown in Table XII and utilizing processing solutions given below.

TABLE XII

| Steps | Processing Time | Processing temp. (°C.) | Tank Volume (liter) | Amount Replenished* (ml) |
|---|---|---|---|---|
| Color Develop- | 2 min. | 38 | 8 | 15 |

TABLE XII-continued

| Steps | Processing Time | Processing temp. (°C.) | Tank Volume (liter) | Amount Replenished* (ml) |
|---|---|---|---|---|
| ment | 30 sec. | | | |
| Bleaching-Fixing | 3 min. | 38 | 8 | 25 |
| Water Washing (1) | 30 sec. | 35 | 4 | (see Table XIII) |
| Water Washing (2) | 30 sec. | 35 | 4 | |
| Water Washing (3) | 30 sec. | 35 | 4 | |
| Stabilization | 30 sec. | 35 | 4 | 5 |

*This was expressed as the amount per unit length (1 ml) of the photosensitive material (width: 35 mm).

In the foregoing processing steps, water washing steps (1) to (3) were carried out according to counter-current water washing system from (3) to (1). Each processing solution had the following composition:

| Component | Mother Liquor (g) | Replenishing Solution (g) |
|---|---|---|
| (Color Development Solution) | | |
| Diethylenetriaminepentaacetic acid | 1.0 | 1.1 |
| 1-Hydroxyethylidene-1,1-diphosphonic acid | 2.0 | 2.2 |
| Sodium Sulfite | 4.0 | 4.9 |
| Potassium Carbonate | 30.0 | 42.0 |
| Potassium Bromide | 1.6 | — |
| Potassium Iodide | 2.0(mg) | — |
| Hydroxylamine | 2.4 | 3.6 |
| 4-(N-Ethyl-N-beta-hydroxyethyl-amino)-2-methylaniline Sulfate | 5.0 | 7.3 |
| Water (Amount required to obtain 1 liter of the intended solutions) | | |
| pH | 10.00 | 10.05 |
| (Bleaching-Fixing Solution) | | |
| Ferric Ammonium Ethylene-diaminetetraacetate | 60.0 | 66.0 |
| Disodium Ethylenediamine-tetraacetate | 10.0 | 11.0 |
| Sodium Sulfite | 12.0 | 20.0 |
| Ammonium Thiosulfate (70% (w/v) aqueous solution) | 220 (ml) | 250 (ml) |
| Ammonium Nitrate | 10.0 | 12.0 |
| Bleaching Agent | 0.4 | 0.7 |

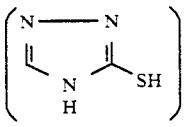

| | | |
|---|---|---|
| Aqueous Ammonia | 13.0 (ml) | 12.0 (ml) |
| Water (Amount required to form 1 liter of these solutions) | | |
| pH | 6.7 | 6.5 |
| (Stabilization Solution) | | |
| Formalin (37% w/v) | 2.0 ml | |
| Polyethylene-p-monononyl phenyl ether (average degree of polymelization = 10) | 0.3 g | |
| EDTA-2Na | 0.05 g | |
| Water (Amount required to form 1 liter of the solution) | | |
| pH | 5.0-8.0 | |

Water washing processes and other conditions of processing were shown in the following Table XIII.

TABLE XIII

| Run. | Conditions of Processing (A)*3 (ml) | (B)*4 (ml) | (B/A) | Washing Water | Amount Processed |
|---|---|---|---|---|---|
| 1 | 2 | 800 | 400 | C | 30 m/day × 10 days |
| 2 | 2 | 800 | 400 | D | " |
| 3 | 2 | 80 | 40 | C | " |
| 4 | 2 | 80 | 40 | D | " |
| 5 | 2 | 8 | 4 | C | " |
| 6 | 2 | 8 | 4 | D | " |

*3 This is the same as that disclosed in Example 3.
*4 This is the value on the basis of the unit length (1 m) of the processed photosensitive material (width = 35 mm).

The washing water C and D (which were also used as the replenishing washing water) appearing in Table XIII were as follows:

Washing Water C: Tap Water

| | |
|---|---|
| pH | 7.4 |
| Ca Ions | 42 mg/l |
| Mg Ions | 10 mg/l |

Washing Water D

This was obtained by treating the above tap water with an apparatus for reverse osmosis provided with a membrane of polyether sulfone having a surface area of 1.3 $m^2$ under a pressure of 13 $kg/cm^2$ and then adding EDTA-2Na to the resultant water.

| | |
|---|---|
| pH | 7.1 |
| Ca Ions | 2.5 mg/l |
| Mg Ions | 0.5 mg/l |
| EDTA-2Na | 200 mg/l |

After continuing the processing as shown in Table XIII for 14 days, the concentrations of calcium and magnesium in the final water washing bath (third bath) were determined according to atomic absorption spectroscopy as well as the turbidity of water in each of the water washing baths was also inspected.

Thereafter, the color negative films N1, N2 and N3 were processed and then these films were examined on whether the proliferation of mold on the processed color negative films was observed or not when they were maintained under high temperature and humidity conditions. Results obtained are shown in the following Table XIV.

TABLE XIV

| Running | Concn. in Final Water Washing Bath Ca (mg/l) | Mg (mg/l) | Ratio (B/A) |
|---|---|---|---|
| 1* | 34 | 7 | 160 |
| 2* | 2.5 | 0.8 | 160 |
| 3* | 27 | 8 | 50 |
| 4 | 2.7 | 0.9 | 50 |
| 5* | 24 | 7 | 10 |
| 6 | 2.9 | 1.1 | 10 |

| Running | Turbidity of Washing Water | Kind of Color Negative film | Proliferation of Mold |
|---|---|---|---|
| 1* | (−) | N1 | (+) |
| | | N2 | (+) |
| | | N3 | (+) |
| 2* | (−) | N1 | (+) |
| | | N2 | (+) |
| | | N3 | (+) |
| 3* | (+) | N1 | (+) |
| | | N2 | (+) |

TABLE XIV-continued

| | | | |
|---|---|---|---|
| | | N3 | (++) |
| 4 | (−) | N1 | (−) |
| | | N2 | (−) |
| | | N3 | (+) |
| 5* | (++) | N1 | (++) |
| | | N2 | (++) |
| | | N3 | (+++) |
| 6 | (−) | N1 | (−) |
| | | N2 | (−) |
| | | N3 | (−) |

*Comparative Example

The meanings of the ideograms (−), (+), (++) and (+++) appearing in this Table have already been given above in connection with Table XI.

As seen from the results given in Table XIV, it is clear that the invention makes it possible to substantially suppress the increase in turbidity of the washing water and the proliferation of mold on the color negative films tested by limiting the amount of calcium and magnesium coexisting in the washing water if the ratio (B/A) is 40 and 10 which are within the range defined in the present invention as well as EDTA is added to the washing water.

EXAMPLE 5

Color paper and color negative films were prepared according to the same procedures as those in Example 1 or Example 4 except that the yellow couplers, cyan couplers and magenta couplers as used therein were partially or completely replaced with those listed below and the resulting color paper and color negative films were developed in accordance with those processes described in Example 1 or 4 except for using a desalted water containing a chelating agent which fulfilled the requirements defined in the present invention to wash the processed paper or films. The same excellent results as in Examples 1 and 4 were obtained.

Yellow Coupler (Y-1)

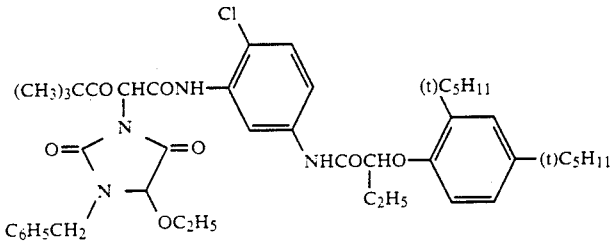

(Y-2)

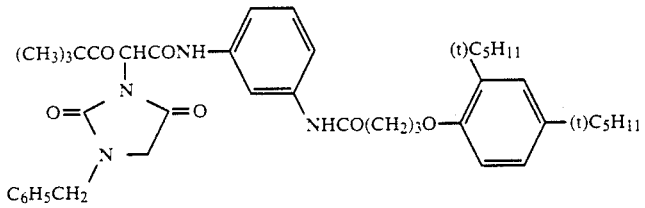

(Y-3)

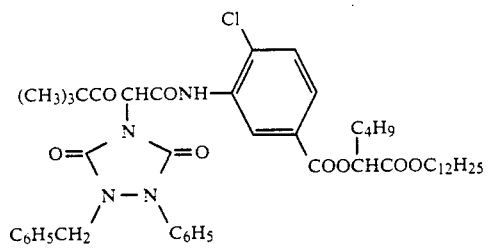

Magenta Coupler (M-1)

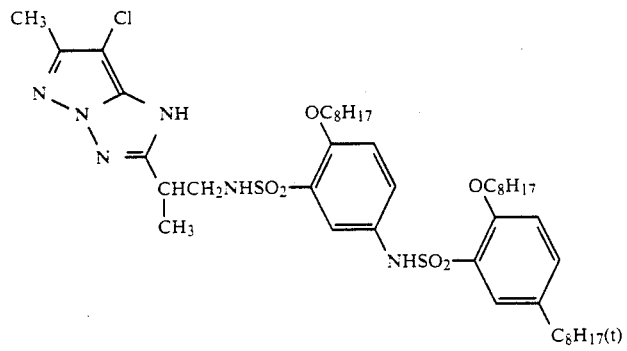

-continued
(M-2)
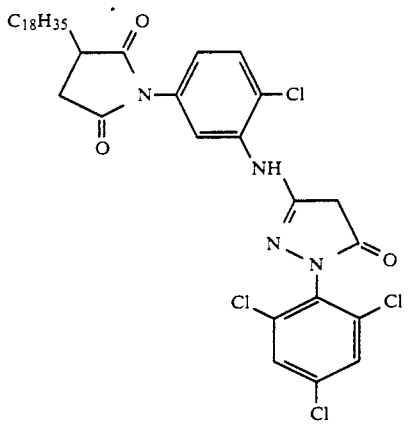
(M-3)
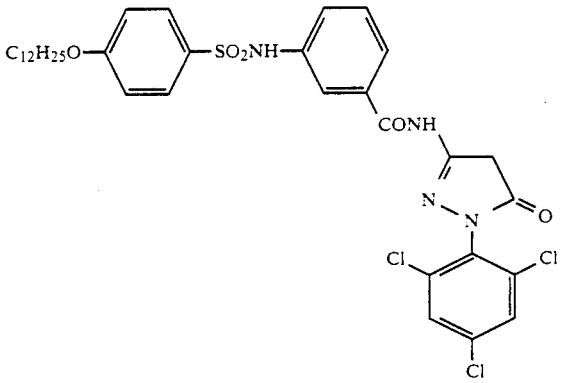
(M-4)
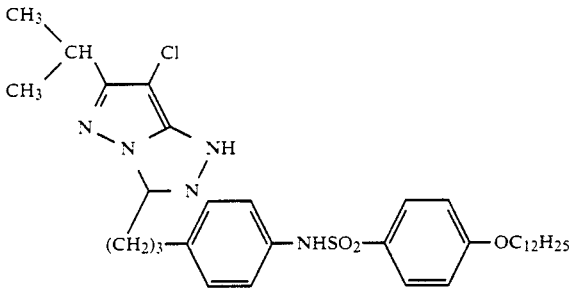
Cyan Coupler
(C-1)
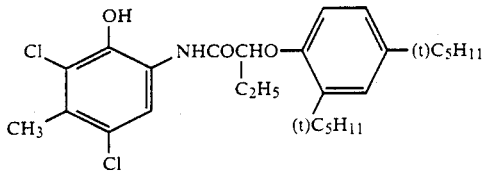
(C-2)
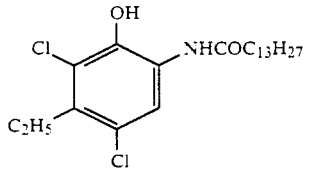

-continued (C-3)

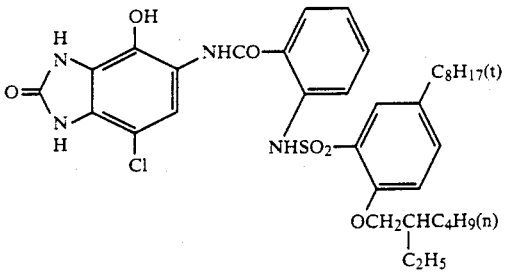

(C-4)

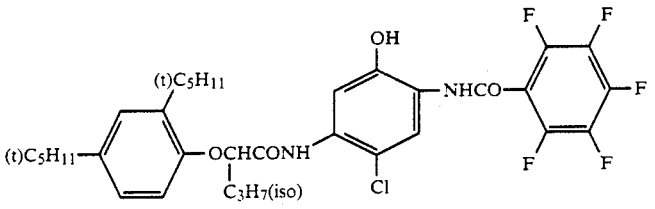

(C-5)

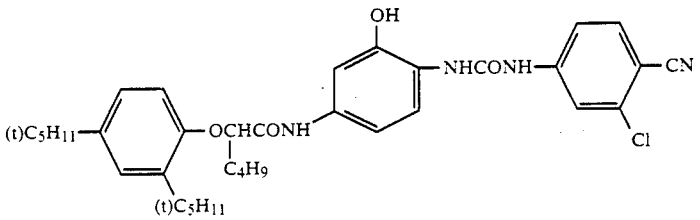

(C-6)

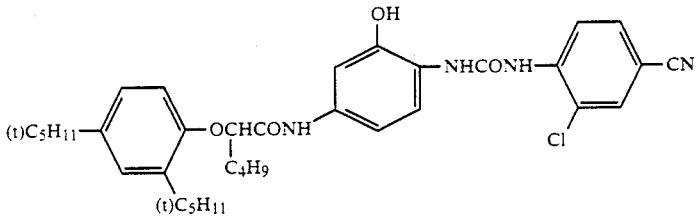

EXAMPLE 6

A multilayered color photographic material having the following layers of the compositions given below was formed on a substrate of a cellulose triacetate film provided with an underlying coating.

Composition of the Photosensitive Layer

In the following formulations, the coated amount of silver halide and colloidal silver is expressed as the weight of silver per unit area (1 $m^2$) of the photosensitive material, that of couplers, additives and gelatin is expressed as the weight thereof per unit area (1 $m^2$) of the photosensitive material and that of sensitizing dyes is expressed as molar number thereof per mole of the silver halide in the same layer.

| | |
|---|---|
| 1st Layer: Antihalation Layer | |
| Black Colloidal Silver | 0.4 |
| Gelatin | 1.3 |
| Colored Coupler C-I | 0.06 |
| UV Absorber U-1 | 0.1 |
| UV Absorber U-3 | 0.2 |
| Dispersion Oil Oil-1 | 0.01 |
| Dispersion Oil Oil-2 | 0.01 |
| 2nd Layer: Intermediate Layer | |
| Silver Bromide of Fine Grain (average grain size = 007 microns) | 0.15 |
| Gelatin | 1.0 |
| Colored Coupler C-II | 0.02 |

-continued

| | |
|---|---|
| Dispersion Oil Oil-1 | 0.1 |
| 3rd Layer: First Red-sensitive Emulsion Layer | |
| Silver Iodobromide Emulsion (AgI content = 6 mole %; ratio of diameter to thickness = 2.5; average grain size = 0.3 microns) | 1.5 (Ag) |
| Gelatin | 0.6 |
| Sensitizing Dye 1 | $1.0 \times 10^{-4}$ |
| Sensitizing Dye 2 | $3.0 \times 10^{-4}$ |
| Sensitizing Dye 3 | $1 \times 10^{-5}$ |
| Coupler C-III | 0.06 |
| Coupler C-IV | 0.06 |
| Coupler C-VIII | 0.04 |
| Coupler C-II | 0.03 |
| Dispersion Oil Oil-1 | 0.03 |
| Dispersion Oil Oil-3 | 0.012 |
| 4th Layer: Second red-sensitive Emulsion Layer | |
| Silver Iodobromide Emulsion (AgI content = 6 mole %; ratio of diameter to thickness = 3.5; average grain size = 0.5 microns) | 1.5 (Ag) |
| Sensitizing Dye 1 | $1.0 \times 10^{-4}$ |
| Sensitizing Dye 2 | $3.0 \times 10^{-4}$ |
| Sensitizing Dye 3 | $1 \times 10^{-5}$ |
| Coupler C-III | 0.24 |
| Coupler C-IV | 0.24 |
| Coupler C-VIII | 0.04 |
| Coupler C-II | 0.04 |
| Dispersion Oil Oil-1 | 0.15 |
| Dispersion Oil Oil-3 | 0.02 |
| 5th Layer: Third Red-sensitive Emulsion Layer | |
| Silver Iodobromide Emulsion (AgI content = 10 mole %; ratio of | 2.0 (Ag) |

-continued

| | |
|---|---|
| diameter to thickness = 1.5; average grain size = 0.7 microns) | |
| Gelatin | 1.0 |
| Sensitizing Dye 1 | $1 \times 10^{-4}$ |
| Sensitizing Dye 2 | $3 \times 10^{-4}$ |
| Sensitizing Dye 3 | $1 \times 10^{-5}$ |
| Coupler C-VI | 0.05 |
| Coupler C-VII | 0.1 |
| Dispersion Oil Oil-1 | 0.01 |
| Dispersion Oil Oil-2 | 0.05 |
| 6th Layer: Intermediate Layer | |
| Gelatin | 1.0 |
| Compound Cpd-A | 0.03 |
| Disperson Oil Oil-1 | 0.05 |
| 7th Layer: First Green-sensitive Emulsion Layer | |
| Silver Iodobromide Emulsion (AgI content = 6 mole %; ratio of diameter to thickness = 2.5; average grain size = 0.3 microns) | 0.7 (Ag) |
| Gelatin | 1.0 |
| Sensitizing Dye 4 | $5 \times 10^{-4}$ |
| Sensitizing Dye 5 | $0.3 \times 10^{-4}$ |
| Sensitizing Dye 6 | $2 \times 10^{-4}$ |
| Coupler C-IX | 0.2 |
| Coupler C-V | 0.03 |
| Coupler C-I | 0.03 |
| Compound Cpd-C | 0.012 |
| Dispersion Oil Oil-1 | 0.5 |
| 8th Layer: Second Green-sensitive Emulsion Layer | |
| Silver Iodobromide Emulsion (AgI content = 5 mole %; ratio of diameter to thickness = 3.5; average grain size = 0.5 microns) | 1.4 (Ag) |
| Sensitizing Dye 4 | $5 \times 10^{-4}$ |
| Sensitizing Dye 5 | $2 \times 10^{-4}$ |
| Sensitizing Dye 6 | $0.3 \times 10^{-4}$ |
| Coupler C-IX | 0.25 |
| Coupler C-V | 0.01 |
| Coupler C-I | 0.03 |
| Coupler C-X | 0.015 |
| Compound Cpd-C | 0.012 |
| Dispersion Oil Oil-1 | 0.2 |
| 9th Layer: Third Green-sensitive Emulsion Layer | |
| Silver Iodobromide Emulsion (AgI content = 10 mole %; ratio of diameter to thickness = 1.5; average grain size = 0.7 microns) | 1.9 (Ag) |
| Gelatin | 1.0 |
| Sensitizing Dye 7 | $3.5 \times 10^{-4}$ |
| Sensitizing Dye 8 | $1.4 \times 10^{-4}$ |
| Coupler C-XI | 0.01 |
| Coupler C-XII | 0.03 |

-continued

| | |
|---|---|
| Coupler C-XIII | 0.20 |
| Coupler C-I | 0.02 |
| Coupler C-XV | 0.02 |
| Dispersion Oil Oil-1 | 0.20 |
| Dispersion Oil Oil-2 | 0.05 |
| 10th Layer: Yellow Filter Layer | |
| Gelatin | 1.2 |
| Yellow Colloidal Silver | 0.16 |
| Compound Cpd-B | 0.1 |
| Dispersion Oil Oil-1 | 0.3 |
| 11th Layer: First Blue-sensitive Emulsion Layer | |
| Monodispersed Silver Iodobromide Emulsion (AgI content = 6 mole %; ratio of diameter to thickness = 1.5; average grain size = 0.3 microns) | 1.0 (Ag) |
| Gelatin | 1.0 |
| Sensitizing Dye 9 | $2 \times 10^{-4}$ |
| Coupler C-XIV | 0.9 |
| Coupler C-V | 0.07 |
| Dispersion Oil Oil-1 | 0.2 |
| 12th Layer: Second Blue-sensitive Emulsion Layer | |
| Silver Iodobromide Emulsion (AgI content = 10 mole %; ratio of diameter to thickness = 1.5; average grain size = 1.5 microns) | 0.9 (Ag) |
| Gelatin | 0.6 |
| Sensitizing Dye 9 | $1 \times 10^{-4}$ |
| Coupler C-XIV | 0.25 |
| Dispersion Oil Oil-1 | 0.07 |
| 13th Layer: First Protective Layer | |
| Gelatin | 0.8 |
| UV Absorber U-1 | 0.1 |
| UV Absorber U-2 | 0.2 |
| Dispersion Oil Oil-1 | 0.01 |
| Dispersion Oil Oil-2 | 0.01 |
| 14th Layer: Second Protective Layer | |
| Silver Iodobromide of Fine Grain (average grain size = 0.07 microns) | 0.5 |
| Gelatin | 0.45 |
| Polymethylmethacrylate Particles (diameter = 1.5 microns) | 0.2 |
| Hardening Agent H-1 | 0.4 |
| Formaldehyde Scavenger S-1 | 0.5 |
| Formaldehyde Scavenger S-2 | 0.5 |

In each of these layers, a surfactant was incorporated as a coating additive in addition to the aforementioned components. The Sample thus prepared will hereunder be referred to as "Sample N4".

Nomenclature or the structural formula of the compounds used in this Example will be given below:

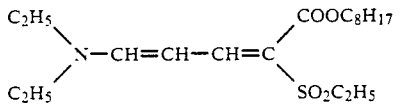

U-3

| | |
|---|---|
| Tricresyl Phosphate | Oil-1 |
| Dibutyl Phthalate | Oil-2 |
| Bis(2-ethylhexyl) Phthalate | Oil-3 |

-continued
C-I
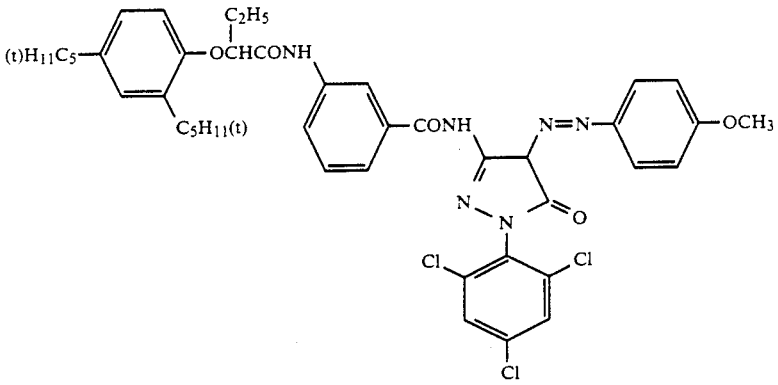
C-II
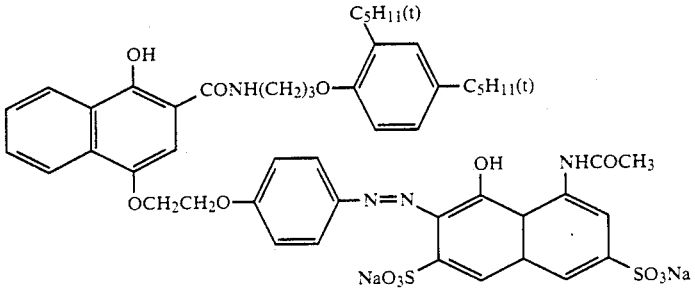
C-III
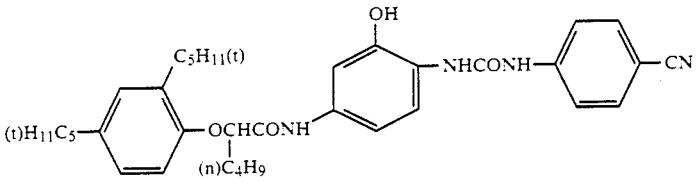
C-IV
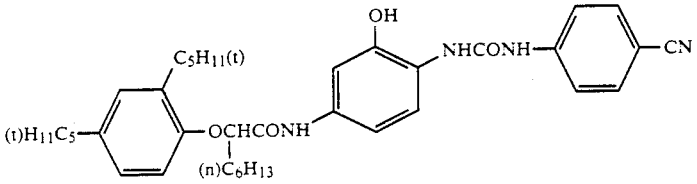
C-V
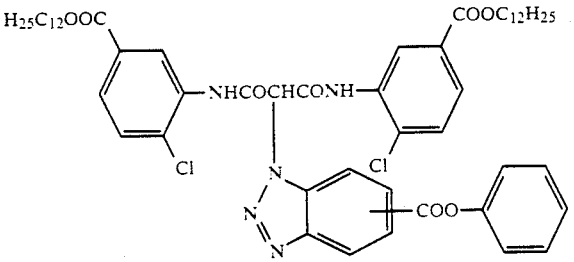

-continued
C-VI
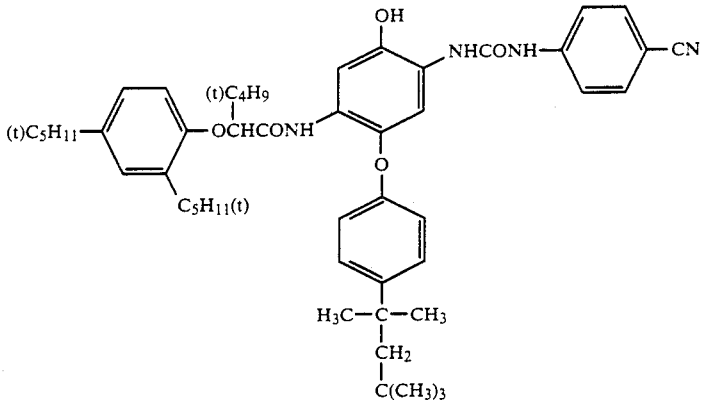
C-VII
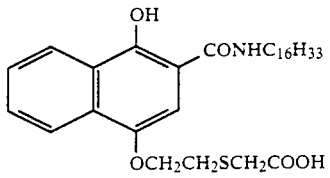
C-VIII
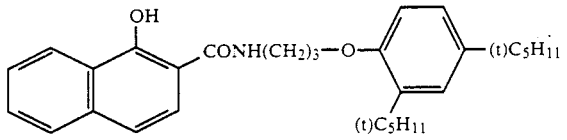
C-IX
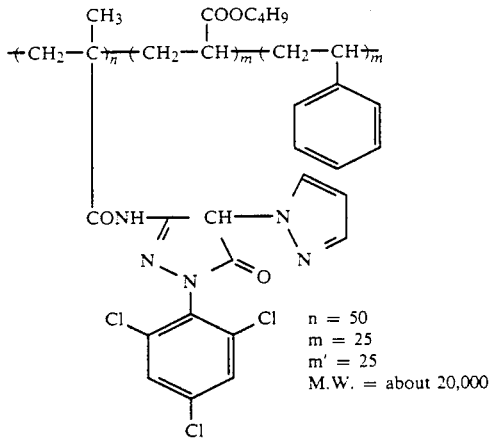
C-X
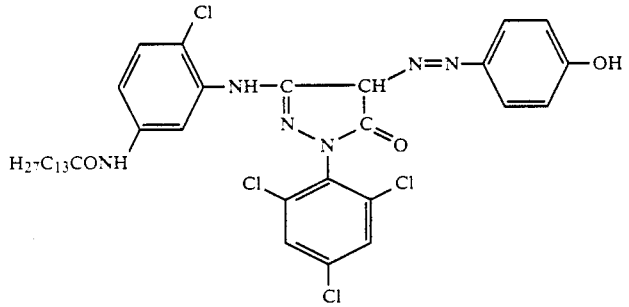

-continued
C-XI
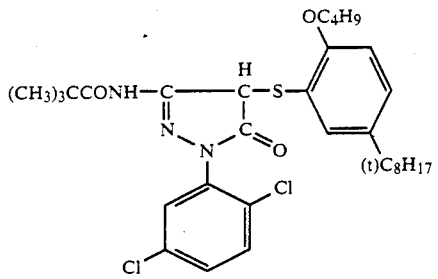
C-XII
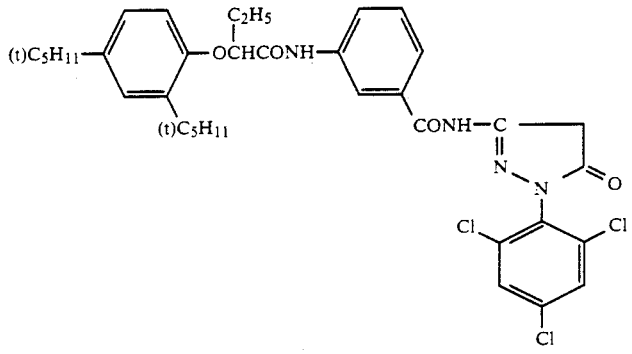
C-XIII
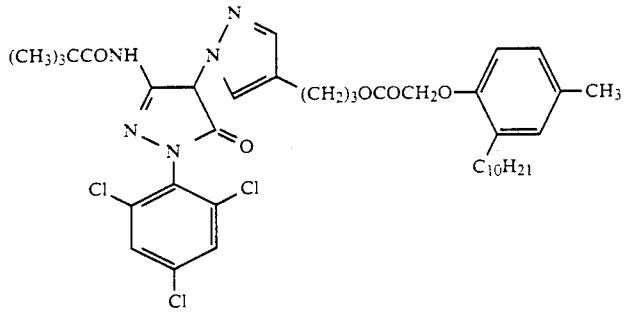
C-XIV
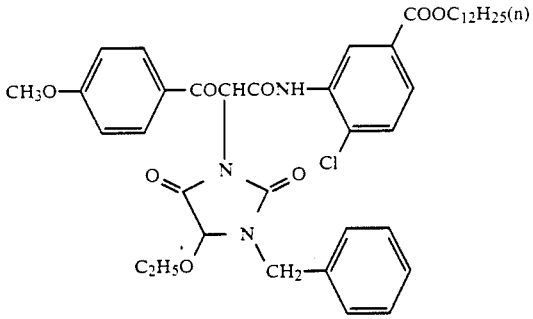
C-XV
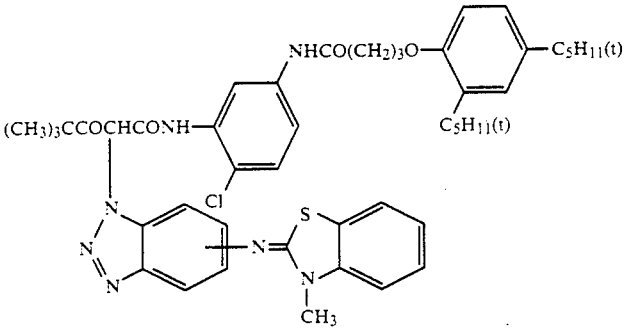

-continued
Sensitizing Dye 1
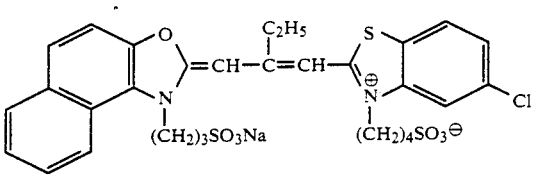
Sensitizing Dye 2
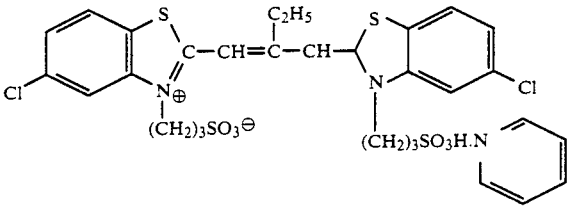
Sensitizing Dye 3
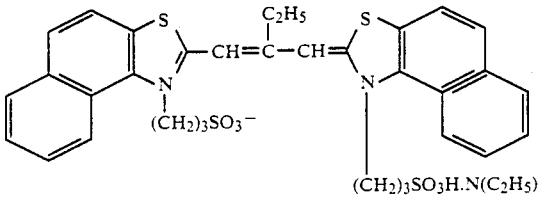
Sensitizing Dye 4
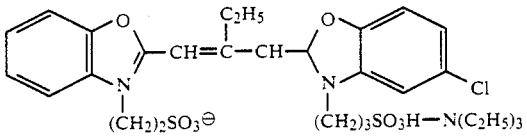
Sensitizing Dye 5
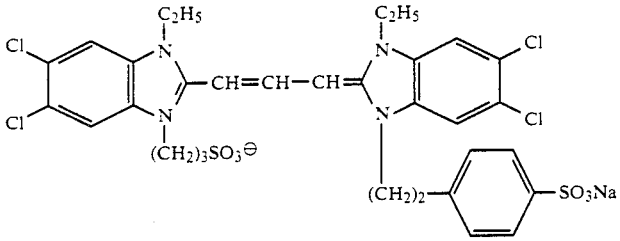
Sensitizing Dye 6
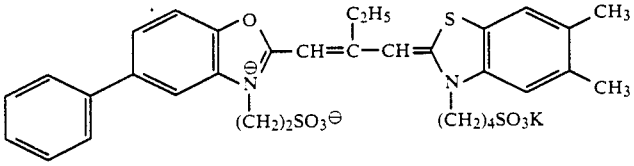
Sensitizing Dye 7
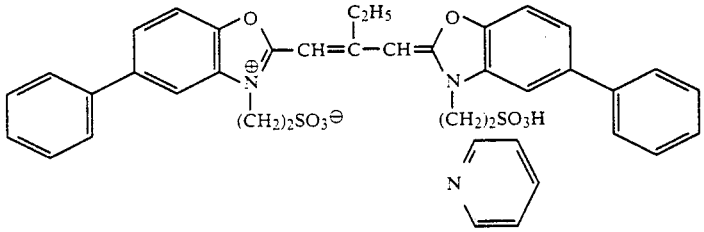

-continued

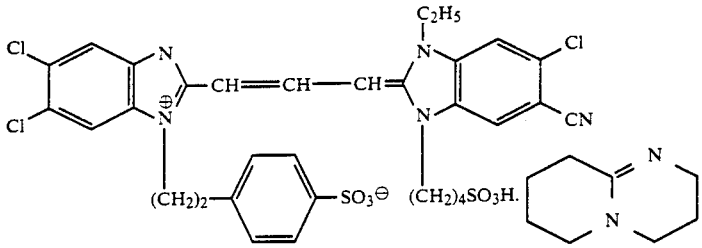

Sensitizing Dye 8

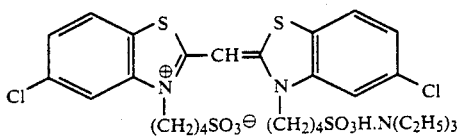

Sensitizing Dye 9

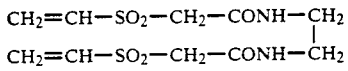

H-1

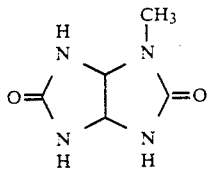

S-1

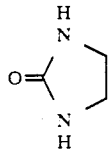

S-2

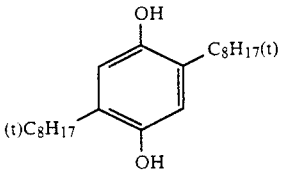

Cpd-A (Cpd-B)

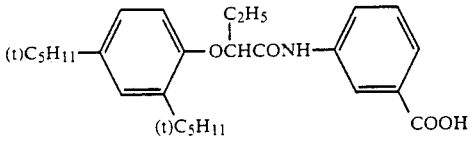

Cpd-C

The multilayered color negative film, Sample N4, thus prepared was cut into continuous band-like ones having a width of 35 mm and then a standard object was photographed in the open air utilizing the cut Sample N4. Thereafter, Sample N4 was processed, by an autodeveloping machine, according to the processing steps described in Table XV given below.

TABLE XV

| Steps | Steps of the Processing: Processing Time | Volume of Tank (1) | Amount Replenished* (ml) |
|---|---|---|---|
| Color Development | 3 min. 15 sec. | 10 | 38 |
| Bleaching | 1 min. | 4 | 18 |
| Bleaching-Fixing | 3 min. 15 sec. | 10 | 27 |

TABLE XV-continued

| Steps | Steps of the Processing: Processing Time | Volume of Tank (1) | Amount Replenished* (ml) |
|---|---|---|---|
| Water Washing (1) | 40 sec. | 4 | Multistage Water Washing System 30 |
| Water Washing (2) | 40 sec. | 4 | |
| Water | 40 sec. | 4 | |

*This amount is expresesd as that per unit length (1 m) of the processed photosensitive material (35 mm in width).

In the foregoing processing steps, the processing temperature of the color development, bleaching and bleaching-fixing steps was 38° C. and that in the water washing steps was 35° C. Moreover, the water washing steps (1) to (3) were carried out according to multistage countercurrent system.

In addition, the overflow liquid from the bleaching bath was introduced into the bleaching-fixing bath. The processing solutions having the following compositions were used in this Example.

(Color Developing Solution)

| Component | Mother Liquor (g) | Replenishing Solution (g) |
|---|---|---|
| Diethylenetriaminepentaacetic acid | 1.0 | 1.1 |
| 1-Hydroxyethylidene-1,1-diphosphonic acid | 2.0 | 2.2 |
| Sodium Sulfite | 4.0 | 4.4 |
| Potassium Carbonate | 30.0 | 32.0 |
| Potassium Bromide | 1.4 | 0.7 |
| Potassium Iodide | 1.3 (mg) | — |
| Hydroxylamine | 2.4 | 2.6 |
| 4-(N-Ethyl-N-beta-hydroxyethyl-amino)-2-methylaniline sulfate | 4.5 | 5.0 |
| Water (Amount required to form 1 liter of the intended solutions) | | |
| pH | 10.00 | 10.05 |

(Bleaching Solution)

| Component | Mother Liquor and Replenishing Solution (g) |
|---|---|
| Ammonium Bromide | 100 |
| Ferric Ammonium Ethylenediamine-tetraacetate | 120 |
| Disodium Ethylenediaminetetraacetate | 10.0 |
| Ammonium Nitrate | 10.0 |
| Bleaching Accelerator ($(N(CH_3)_2—(CH_2)_2—S—S—(CH_2)_2—N(CH_3)_2)$) | 2.0 |
| Aqueous Ammonia | 17.0 (ml) |
| Water (Amount required to form 1 liter of the intended solutions) | |
| pH | 6.5 |

(Bleaching-Fixing Solution)

| Component | Mother Liquor (g) | Replenishing Solution (g) |
|---|---|---|
| Ammonium Bromide | 50.0 | — |
| Ferric Ammonium Ethylenediamine-tetraacetate | 50.0 | — |
| Disodium Ethylenediamine-tetraacetate | 5.0 | 1.0 |
| Sodium Sulfite | 12.0 | 20.0 |
| Aqueous Solution of Ammonium Thiosulfate (70%) | 240 (ml) | 400 (ml) |
| Aqueous Ammonia | 10 (ml) | — |
| Water (Amount required to form 1 liter of the intended solutions) | | |
| pH | 7.3 | 8.0 |

Washing Water

Washing Water E

Tap water which is identical with the washing water C used in Example 4;

Washing Water F

This was obtained by bringing the tap water (washing water E) into contact with a chelate resin (manufactured and sold under the trade name of Diaion CR-10 by Mitsubishi Chemical Industries Ltd.) to limit the amount of calcium and magnesium content to not more than 3 mg/l and then adding 100 mg/l of disodium ethylenediaminetetraacetate.

In all processings in which the foregoing washing water E and F utilized, a photosensitive material (35 mm in width) was processed at a rate of 30 m per day over 15 days (5 days per week) followed by the cessation of the processing for 10 days. Thereafter, the conditions of the water washing bath were inspected and results observed were listed in the following Table XVI.

TABLE XVI

| Running | Washing Water | Conditions in the Water Washing Bath |
|---|---|---|
| 1* | E | Formation of a bacterial floating matter on the water surface; high turbidity of the washing solution. |
| 2 | F | Observed no bacterial floating matter; very low turbidity; clear. |

As seen from the results shown in Table XVI, it is evident that the washing water was clear even after the developing machine was stopped for a long period of time according to the present invention.

What is claimed is:

1. A method for processing silver halide photosensitive materials comprising developing an exposed silver halide photosensitive materials, fixing the developed photosensitive materials and then washing it with a washing water, the washing water used in the water washing process being replenished in an amount of 2 to 50 times the volume of liquid carried over by the photosensitive material from a bath preceding the water washing bath per unit area thereof, the amount of calcium and magnesium compounds present in the washing water in a final washing bath of the washing process being reduced to not more than 5 mg/l, respectively, on the basis of elemental calcium and magnesium, the amount of calcium and magnesium compounds present in the replenishing washing water being not more than 5 mg/l, respectively, on the basis of elemental calcium and magnesium, and the washing water containing at least one chelating agent having a stability constant of a chelate which is formed between the chelating agent and the calcium or magnesium, of at least 6.

2. The method for processing as set forth in claim 1 wherein the stability constant of the chelate of the chelating agent with calcium or magnesium is not less than 8.

3. The method for processing as set forth in claim 1 wherein the stability constant of the chelate of the chelating agent with calcium or magnesium is not less than 10.

4. The method for processing as set forth in claim 1 wherein the chelating agent is at least one member selected from the group consisting of ethylenediaminetetraacetic acid, cyclohexanediaminetetraacetic acid, diethylenetriaminepentaacetic acid, hydroxyethyl ethylenediaminetriacetic acid, triethylenetetraminehexaacetic acid, diaminopropanoltetraacetic acid, 1,2-diaminopropanetetraacetic acid, ethylenediaminetetramethylene phosphonic acid, ethylenediamine-N,N'-diacetic acid-di-(2-propionic acid), 1,3-diaminopropanetetraacetic acid and alkali metal salts and ammonium salts thereof.

5. The method for processing as set forth in claim 1 wherein the content of the chelating agent ranges from $3\times10^{-4}$ to $3\times10^{-2}$ moles per liter of the washing water.

6. The method for processing as set forth in claim 5 wherein the content of the chelating agent is in the range of from $1\times10^{-3}$ to $1\times10^{-2}$ moles per liter of the washing water.

7. The method for processing as set forth in claim 1 wherein the water washing process comprises at least two washing baths and replenishing washing water is countercurrently introduced into the baths.

8. The method for processing as set forth in claim 7 wherein the water washing process comprises 2 to 6 baths.

9. The method for processing as set forth in claim 1 wherein the amount of calcium and magnesium compounds in the replenishing washing water is controlled by employing an ion exchange resin or an apparatus for reverse osmosis.

10. The method for processing as set forth in claim 1 wherein the washing water is replenished into the water washing bath in an amount of 3 to 30 times the volume of liquid carried over by the processed photosensitive material from a bath preceding the water washing bath per unit area thereof.

11. The method for processing as set forth in claim 1 wherein the concentration of calcium and magnesium compounds in the replenishing water is not more than 3 mg/l.

12. The method for processing as set forth in claim 1 wherein the amount of calcium and magnesium present in the final bath in the water washing process in reduced to not more than 3 mg/l.

13. The method for processing as set forth in claim 1 wherein the color development process is carried out under a condition of substantially free from benzyl alcohol.

14. The method for processing as set forth in claim 1 wherein the fixing process is carried out with a fixing solution or a bleaching-fixing solution.

15. The method for processing as set forth in claim 1 wherein the replenishing washing water is irradiated with ultraviolet light.

16. The method for processing as set forth in claim 7, wherein the water washing process comprises 2 to 4 baths.

* * * * *